US006196655B1

(12) United States Patent
Hirasawa et al.

(10) Patent No.: US 6,196,655 B1
(45) **Date of Patent: *Mar. 6, 2001**

(54) INK-JET RECORDING APPARATUS AND RECOVERY PROCESS METHOD OF THE SAME

(75) Inventors: Shinichi Hirasawa; Koichi Sato, both of Hiratsuka; Koji Terasawa, Mitaka; Akira Miyakawa, Tanashi; Tsutomu Abe, Isehara; Yoshifumi Hattori, Yamato, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/123,269

(22) Filed: Sep. 20, 1993

Related U.S. Application Data

(62) Division of application No. 07/783,820, filed on Oct. 29, 1991, now Pat. No. 5,311,214, which is a division of application No. 07/559,977, filed on Jul. 30, 1990, now abandoned, which is a continuation of application No. 07/364,548, filed on Jun. 2, 1989, now abandoned, which is a continuation of application No. 07/196,820, filed on May 19, 1988, now abandoned, which is a continuation of application No. 06/926,543, filed on Nov. 4, 1986, now abandoned.

(30) Foreign Application Priority Data

| | | |
|---|---|---|
| Nov. 8, 1985 | (JP) | 60-249001 |
| Nov. 8, 1985 | (JP) | 60-249002 |
| Nov. 8, 1985 | (JP) | 60-249003 |
| Nov. 8, 1985 | (JP) | 60-249004 |
| Nov. 8, 1985 | (JP) | 60-249005 |
| Nov. 8, 1985 | (JP) | 60-249006 |
| Nov. 8, 1985 | (JP) | 60-249007 |
| Nov. 8, 1985 | (JP) | 60-249008 |
| Nov. 8, 1985 | (JP) | 60-249009 |
| Nov. 8, 1985 | (JP) | 60-249010 |

(51) Int. Cl.[7] ..... B41J 2/165
(52) U.S. Cl. ..... 347/25; 347/30
(58) Field of Search ..... 346/1.1, 140; 347/25, 347/30, 44

(56) References Cited

U.S. PATENT DOCUMENTS

| | | |
|---|---|---|
| 3,929,071 | 12/1975 | Cialone et al. . |
| 3,974,508 | 8/1976 | Blumenthal . |

(List continued on next page.)

FOREIGN PATENT DOCUMENTS

| | | |
|---|---|---|
| 2460573 | 1/1976 | (DE) . |
| 2556169 | 6/1976 | (DE) . |

(List continued on next page.)

OTHER PUBLICATIONS

J. Mako et al., "Cleaning Ink Jet Nozzles", IBM Technical Disclosure Bullentin, Vol. 19, No. 10, pp. 3703–3704.*

*Primary Examiner*—Joan Pendegrass
(74) *Attorney, Agent, or Firm*—Fitzpatrick, Cella, Harper & Scinto

(57) ABSTRACT

There is disclosed a method and apparatus for recovering an ink jet head having an opening communicating with a discharge port, the opening being provided on a same planar surface on which the discharge port for discharging ink is provided. An area of the opening is larger than an area of the discharge port. The method includes the steps of forcibly introducing gas into the ink jet head simultaneously through the discharge port and the opening, and exhausting the gas introduced into the ink jet head in the introducing step with ink through the discharge port. The gas introduced into the ink jet head enables the ink to be exhausted at an increased velocity in the exhausting step.

10 Claims, 24 Drawing Sheets

U.S. PATENT DOCUMENTS

| | | | | |
|---|---|---|---|---|
| 4,045,802 | | 8/1977 | Fukazawa et al. . | |
| 4,296,418 | | 10/1981 | Yamazaki et al. . | |
| 4,383,263 | * | 5/1983 | Ozawa | 347/30 |
| 4,404,566 | | 9/1983 | Clark et al. . | |
| 4,410,900 | * | 10/1983 | Terasawa | 347/30 |
| 4,476,472 | | 10/1984 | Aiba et al. . | |
| 4,506,277 | * | 3/1985 | Terasawa | 347/30 X |
| 4,542,390 | | 9/1985 | Bruning et al. . | |
| 4,559,543 | * | 12/1985 | Toganoh | 347/25 X |
| 4,577,203 | * | 3/1986 | Kawamura | 347/30 |
| 4,578,687 | * | 3/1986 | Cloutier | 347/44 |
| 4,586,058 | * | 4/1986 | Yamazaki | 347/30 X |
| 4,628,333 | * | 12/1986 | Terasawa | 347/30 X |
| 4,631,556 | * | 12/1986 | Watanabe | 347/30 |
| 4,684,963 | * | 8/1987 | Naka | 347/29 |
| 4,745,414 | | 5/1988 | Okamura et al. . | |
| 4,893,138 | * | 1/1990 | Terasawa | 347/30 |
| 4,970,534 | | 11/1990 | Terasawa et al. . | |
| 5,311,214 | * | 5/1994 | Hirasawa | 346/140 R X |

FOREIGN PATENT DOCUMENTS

| | | | | |
|---|---|---|---|---|
| 2812562 | | 9/1979 | (DE) . | |
| 2929742 | | 2/1981 | (DE) . | |
| 3326717 | | 2/1984 | (DE) . | |
| 3422504 | | 1/1986 | (DE) . | |
| 2294759 | | 12/1975 | (FR) . | |
| 354153033 | * | 12/1979 | (JP) | B41J/3/04 |
| 57-117964 | | 7/1982 | (JP) . | |
| 58-014760 | | 1/1983 | (JP) . | |
| 58-63464 | * | 4/1983 | (JP) | B41J/3/04 |
| 360042051 | * | 3/1985 | (JP) | B41J/3/04 |
| 60-141564 | | 7/1985 | (JP) . | |
| 360141564 | * | 7/1985 | (JP) | B41J/3/04 |

* cited by examiner

INK-JET RECORDING APPARATUS AND RECOVERY PROCESS METHOD OF THE SAME

This application is a division of application Ser. No. 07/783,820 filed Oct. 29, 1991, U.S. Pat. No. 5,311,214, which is a division of application Ser. No. 07/559,977 filed Jul. 30, 1990, abandoned, which is a continuation of application Ser. No. 07/364,548 filed Jun. 2, 1989, abandoned, which is a continuation of application Ser. No. 07/196,820 filed May 19, 1988, abandoned, which is a continuation of application Ser. No. 06/926,543 filed Nov. 4, 1986, abandoned.

DESCRIPTION OF THE INVENTION

1. Field of the Invention

The present invention relates to an ink-jet recording apparatus and a recovery process method of the same.

2. Related Background Art

In an ink-jet recording apparatus, an ink discharge port, such as an orifice provided in a printing head, may be clogged, or bubbles may be mixed in an ink supply path connected to the ink discharge port. This degrades ink droplet discharge performance and causes poor ink discharge.

In conventional ink-jet printing apparatuses, a suction means is provided outside a discharge port to oppose it, and ink is absorbed from the discharge port. Alternatively, pressure is applied to the interior of the ink supply path, to cause the ink to flow at a certain velocity, thus discharging the ink from the discharge port. In this manner, the above-described factors causing poor discharge are eliminated.

In ink-jet recording apparatuses, however, many structures are provided in and along the ink flow path such as the discharge port, a corner or step in the printing head or ink supply path, or a filter provided midway along the supply path for removing foreign material from the supply path. Such structures have a large flow path resistance, and sufficient flow velocity cannot be obtained due to these structures. Therefore, if bubbles are present in these portions, they are not discharged but only ink is discharged, and the factors causing poor discharge cannot be eliminated.

In order to eliminate these poor discharge factors, it has also been proposed to increase the suction force of a suction means or the pressure of a pressure means thus achieving sufficient flow velocity. For this purpose, however, the overall apparatus is inevitably increased in size.

SUMMARY OF THE INVENTION

It is an object of the present invention to provide an ink-jet recording apparatus wherein the above-described problems are solved to maintain a sufficient flow velocity without increasing its size, thus reliably performing ink discharge and recovery processes, and a recovery process method of the same.

It is another object of the present invention to provide an ink-jet recording apparatus wherein foreign material in an ink supply path connected to a discharge port, such as bubbles or dust present in the filter in the supply path or a step or corner of the supply path, can be appropriately removed by a high-velocity fluid, and a recovery process method of the same.

It is still another object of the present invention to provide an ink-jet recording apparatus wherein foreign material in an ink supply path connected to a discharge port, such as bubbles or dust present in the filter in the supply path or a step or corner of the supply path, can be appropriately removed by causing ink to flow without flowing through a discharge port having a high flow path resistance, and a recovery process method of the same.

It is still another object of the present invention to provide an ink-jet recording apparatus wherein a gas is introduced from an opening to an ink supply path to cause ink to flow at a high velocity together with the gas introduced into the ink supply path, thereby discharging the ink quickly and reliably, and a recovery process method of the same.

It is still another object of the present invention to provide an ink-jet recording apparatus wherein ink is caused to flow at a high velocity together with a gas introduced into an ink supply path inside a discharge port, in order to eliminate factors causing poor discharge, such as clogging of the discharge port, as well as to appropriately remove foreign material in the ink supply path connected to the discharge port, such as bubbles or dust present in a filter in the supply path or a step or corner of the supply path, and a recovery process method of the same.

It is still another object of the present invention to provide an ink-jet recording apparatus wherein, once air is introduced by connection, it is appropriately introduced into an ink supply path without being absorbed back even when the discharge path is released and when the ink is to be discharged, it is caused to flow at a high velocity together with the gas introduced into the ink supply path inside the discharge port, so that factors causing poor discharge, such as clogging of the discharge port, can be eliminated, as well as foreign material in the ink supply path connected to the discharge port, such as bubbles or dust present in the filter on the supply path or in a step or corner of the supply path, can be appropriately removed, and a recovery process method of the same.

It is still another object of the present invention to provide an ink-jet recording apparatus wherein, before a gas is introduced into an ink supply path by means of repeated connection/disconnection of the discharge port, ink is discharged to fill a connection means, so that an increased pressure sufficient for air introduction can be obtained, and the ink is caused to flow at a high velocity and is discharged together with the gas introduced into the ink supply path inside the discharge port, so that factors causing poor discharge, such as clogging of the discharge port, can be eliminated, as well as foreign material in the ink supply path connected to the discharge port, such as bubbles or dust present in the filter in the supply path or in a step or corner of the supply path, can be appropriately removed,.and a recovery process method of the same.

It is still another object of the present invention to provide an ink-jet recording apparatus wherein one ink discharge process is performed to discharge ink from a discharge port in order to restore discharge, and a simple operation of holding an ink-containing member at a second mount position (a position for blocking the supply path) is performed in association with the ink discharge process, so that the ink supply path can be reliably blocked, thus assisting a discharge recovery process for increasing the flow velocity of a fluid in the supply path, and a recovery method of the same.

It is further object of the present invention to provide an ink jet recording apparatus for performing recording by discharging ink from a recording head, characterized in that said apparatus comprises;

a branch path branching from a middle point of an ink supply path through which ink is supplied to said recording head; and removing means for removing a foreign material in said ink supply path by flowing the ink through said branch path.

It is a further object of the present invention to provide an ink jet recording apparatus comprising:

a recording head having a discharge port for discharging ink therethrough;

introducing means for introducing air from said discharge port into the interior of said recording head, said introducting means including a connecting part convering said discharge port by the connection thereof to said recording head, transfer means for connecting or separating said connecting portion to or from said recording head, and control means for controlling said connection or separation operation performed by said transfer means to cause said transfer means to repeatedly perform said operation plural times; and discharge means for discharging the ink and/or the introduced air from said discharge port.

It is a further object of the present invention to provide an ink jet recording apparatus for discharging ink from a recording head to a recording meidum to effect recording comprising:

a connecting part connectable to said recording head;

transfer means for performing the connection and separation of said connecting part to and from said recording head;

control means for controlling said transfer means to perform said connection and separation of said connecting portion to and from said recording head;

said control means introducing gas from said discharge port of said recording head into the interior of said recording head by the connection of said connecting part to said recording head;

opening/closing means for communicating the interior of said connecting portion with the atmosphere prior to the release of said connection; and discharge means for discharging gas introduced in the interior of said recording head together with the ink from said discharge port.

It is a further object of the present invention to provide an ink jet recording apparatus for discharging ink from a discharge port, comprising:

a branch path provided midway along an ink supply path for supplying the ink to said recording head therethrough, one end of said branch path opening to atmosphere;

a connecting part for covering said discharge port by the connection thereof to said recording head; and a pump for generating suction power for said ink supplied to said recording head and/or gas introduced into the interior of said ink supply path from said discharge port, said connecting portion and said branch path.

It is a further object of the present invention to provide an ink jet recording apparatus for discharging ink from recording head to a recording medium to effect recording comprising:

a connecting part connectable to said recording head;

transfer means for causing said connecting part to connect and separate to and from said recording head;

control means for controlling said transfer means to cause said connecting part to connect and separate to and from said discharge port, and for introducing gas into the interior of said discharge port by said connection;

discharge means for discharging liquid present in the interior of said discharge port from said discharge port; and discharge control means for causing said connecting part to connect to said discharge port prior to the connection for said introduction of gas, to drive said discharge means.

It is a further object of the present invention to provide an ink jet recording apparatus for discharging ink from a discharge port of a recording head to a recording medium to effect recording, comprising:

limit means provided midway along an ink supply path through which ink is supplied to said recording head, for limiting the quantity of ink to be supplied to said recording head;

introducing means for causing the pressure of the portion between said limit means and said recording head to become negative during the limit operation of said limit means to suck and introduce gas from said discharge port; and discharge means for releasing said limit operation after the introduction of gas, to discharge the introduced gas together with the ink.

It is a further object of the present invention to provide a recovery process of an ink jet recording apparatus comprising the steps:

connecting a connecting part for covering a discharge port through which a recording head discharges ink, to said recording head;

performing the separation of said connecting part from said recording head and thereafter, connecting said connecting part to said recording head after ink is introduced into a suction path which communicates said connecting part with a pump for generating suction power used for performing suction operation of sucking ink from said discharge port through said connecting part; and thereafter, opening an open/closure means for communicating the interior of said connecting part with atmosphere in the state that said connecting part connects to said recording head after the lapse of a predetermined time period from the operation of said suction, to communicate the interior of said connecting part with atmosphere, together with the performance of said suction.

It is a further object of the present invention to provide a recovery process for an ink jet recording apparatus comprising the steps:

connecting a connecting part for covering a discharge port through which a recording head discharges ink, to said recording head;

thereafter causing the pressure of an ink supply path to become negative by means of a pump through said connecting part under the condition that said ink supply path through which ink is supplied to said recording head is closed or the quantity of the ink flow in said ink supply path is decreased;

thereafter, opening open/closure means for communicating the interior of said connecting part to atmosphere, to communicate the interior of said connecting part to atmosphere; and thereafter, performing the suction operation for sucking air and/or ink from said discharge port through said connecting part by a suction power of said pump under the condition that said open/closure means is closed, after the conduction of said ink supply path.

It is a further object of the present invention to provide a recovery process for an ink jet recording apparatus comprising the steps:

connecting a connecting part for covering a discharge port through which a recording head discharges ink, to said recording head;

thereafter, causing an ink supply path through which ink is supplied to said recording head to be closed;

thereafter, opening open/closure means for communicating the interior of said connecting part to the atmosphere to communicate the interior of said connecting part to the atmosphere;

thereafter, performing a sumping operation for generating suction power used for performing a suction operation in which ink is sucked from said discharge port through said connecting part under the condition that a suction path through which said connecting part is communicated to said pump;

thereafter, conducting said suction path and said ink supply path, closing said open/closure means, and thereafter performing said suction operation.

It is a further object of the present invention to provide a recovery process for an ink jet recording apparatus comprising the steps:

connecting a connecting part for covering a discharge port through which a recording head discharges ink, to said recording head;

thereafter, opening open/closure means for communicating the interior of said connecting part to the atmosphere in said connection state;

thereafter, closing an ink supply path for supplying ink to said recording head therethrough or decreasing the quantity of ink supply;

thereafter, operating a pump for generating suction power with which ink is sucked from said discharges port through said connecting part under the condition that said supply path is communicating with a suction path for communicating said connecting part with said pump therethrough;

thereafter, conducting said supply path and closing said open/closure means; and thereafter, shutting off the communication between said suction path and said supply path, and thereafter, operating said pump.

It is yet a further object of the present invention to provide a method for recovering an ink jet head having an opening communicating with a discharge port, the opening being provided on a same planar surface on which the discharge port for discharging ink is provided, an area of the opening being larger than an area of the discharge port. The method includes the steps of forcibly introducing gas into the ink jet head simultaneously through the discharge port and the opening, and exhausting the gas introduced into the ink jet head in the introducing step with ink through the discharge port. The gas introduced into the ink jet head enables the ink to be exhausted at an increased velocity in said exhausting step.

It is an even further object of the present invention to provide an ink jet apparatus for use with a mountable ink jet head having an opening communicating with a discharge port, the opening being provided on a same planar surface on which the discharge port for discharging ink is provided. The apparatus includes introducing means and exhausting means. The introducing means forcibly introduces gas into the ink jet head simultaneously through the discharge port and the opening. The exhausting means exhausts the gas introduced into the ink jet head by the introducing means with ink through the discharge port. An area of the opening is larger than an area of the discharge port. The gas introduced into the ink jet head enables the ink to be exhausted at an increased velocity by the exhausting means.

BRIEF DESCRIPTION OF THE DRAWINGS

FIGS. 18A and 18B to 21A and 21B are plan views of four examples wherein the position of the ink cartridge shown in FIGS. 17A and 17B can be set;

DETAILED DESCRIPTION OF THE PREFERRED EMBODIMENT

The present invention will be described in detail with reference to the accompanying drawings.

Figure 1A:
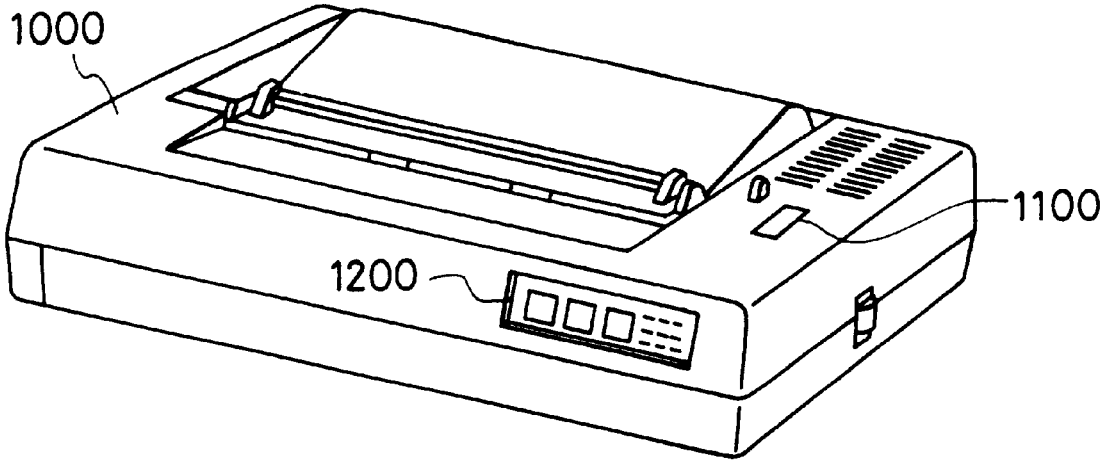
FIGS. 1A and 1B respectively are a perspective view of an outer appearance of an ink-jet recording apparatus to which the present invention can be applied, and a front view of an operation panel provided on a front surface of the apparatus.
Figure 1B:
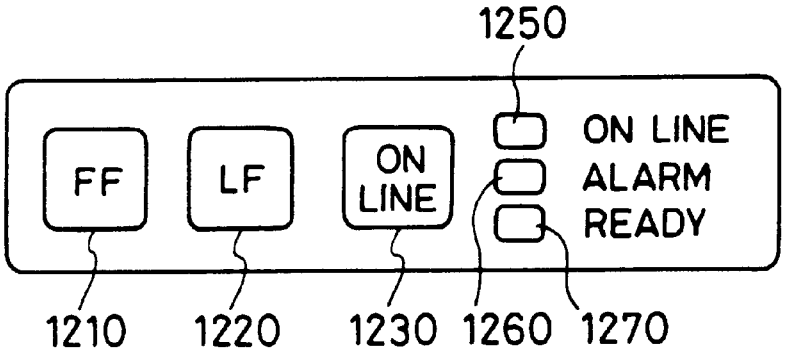
Figure 2:
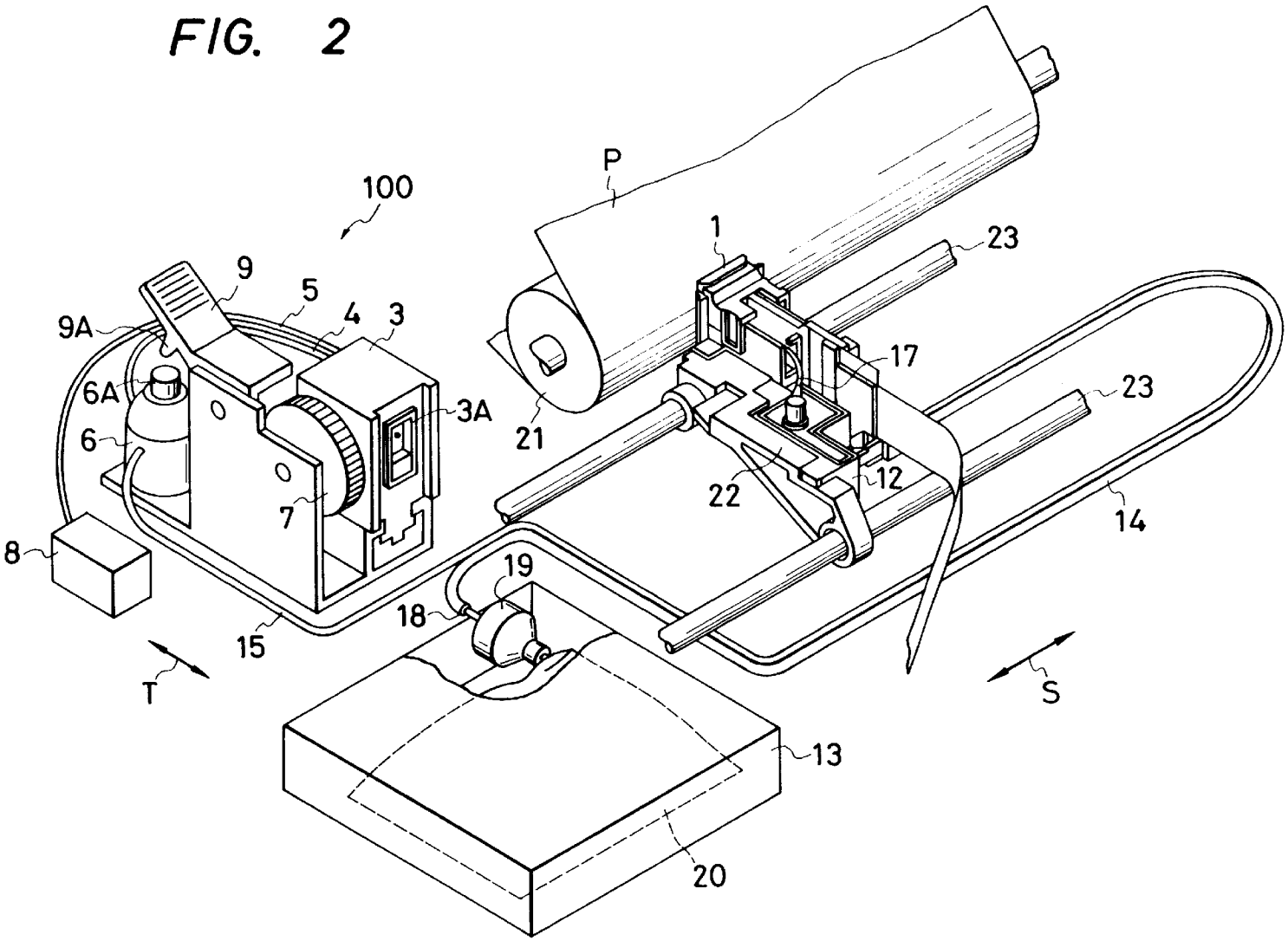
FIGS. 2 and 3 are perspective and plan views, respectively, of a recording section stored in the apparatus shown in FIG. 1A.
Figure 3:
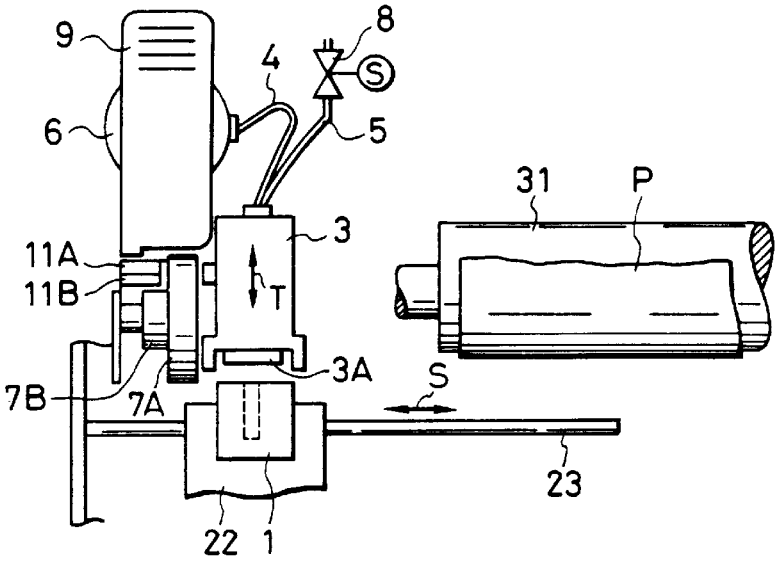

FIGS. 1A and 1B show an outer appearance of an ink-jet recording apparatus to which the present invention can be applied, and an operation panel provided on the front surface of the apparatus, respectively; and FIGS. 2 and 3 show a recording section stored in the apparatus shown in FIG. 1A. A so-called serial type ink-jet recording apparatus will be exemplified.

FIG. 1A illustrates an apparatus main body 1000, a power source switch 1100, and an operation panel 1200. The operation panel 1200 can have, as shown in FIG. 1B, an instruction means, such as FF and LF switches 1210 and 1220 and an on-line switch 1230, and a display means, such as an on-line lamp 1250, an alarm lamp 1260, a ready lamp 1270, and so on. The operator requests to convey a recording medium, such as a paper sheet, by means of the switches 1210 and 1220, and inputs an on-line command by means of the on-line switch 1230. The on-line lamp 1250 displays an on-line state of the apparatus. The alarm lamp 1260 alarms an abnormal state. The ready lamp 1270 signals a ready state.

Referring to FIGS. 2 and 3, a head 1 has an ink discharge port in its front surface opposing a recording sheet P. The head 1 is mounted on a carriage 22, which moves on a shaft 23 in the direction of arrow S in FIG. 2, together with a subtank 12 which supplies ink to the ink chamber of the head 1 through a tube 17. During movement, the head 1 discharges ink droplets from its discharge port and records on the recording sheet P whose recording surface is regulated by a platen roller 21. An ink cartridge 13 is detachably held by the main body 1200, and has an ink bag 20 and an elastic plug 19. When a hollow needle 18 thrusts through the plug 19 and reaches an appropriate position therein, an ink flow path communicates the ink cartridge 13 and the subtank 12 through a supply tube 14.

The ink supplied to the head 1 is set at a negative pressure relative to the ink level at the discharge port. The supplied ink is constantly substantially maintained at a predetermined level by an ink level adjustment tube 15, and the ink is supplied to the discharge port side by the surface tension. Therefore, the ink is not drawn backward from the discharge port. Ink leakage from the discharge port caused by vibration or the like is also prevented.

A cap unit 100 is arranged at the home position of the carriage 22, and performs capping on the head 1 when the carriage 22 is positioned at the home position. In the cap unit 100, a connecting part 3 has a cap 3A, which is made of an elastic material so that it can be connected with the front surface of the head 1, and which protects the discharge port in the no-recording mode. The connecting part 3 and the cap 3A can be integrally formed. A gear 7A and a positioning cam 7B therefor are shown as examples of a transfer means and constitute a connecting part transfer mechanism for transferring the connecting part 3 in directions T in FIG. 2, thus being connected to/detached from the head 1. Connection/detachment positioning can be performed by turning on/off, e.g., a contact 11B of a switch 11 by the cam 7B.

A discharge means has a pump 6 as a suction means. The pump 6 is connected to the interior of the connecting part 3 and the subtank 12 through a tube 4 defining a suction path and the tube 15 for maintaining the ink level in the subtank 12, respectively, and performs suction. An opening/closing means 8 is provided for an atmosphere open tube 5 for releasing the interior of the connecting part 3 to air, and can use, e.g., an electro-magnetic valve. A closable vent valve 5A is arranged between the electro-magnetic valve 8 of the tube 5 and the connecting part 3. An operation lever 9 has a projection 9A for engaging with a member which closes the vent valve and a pump contact 6A, thus driving the pump 6.

In this embodiment, a lever control member including, e.g., a spring and a latch, is arranged. The lever 9 can be set at on- and off-positions and a medium-position thereof. When the lever 9 is moved from the on-position to off-position and released, it is held at the medium-position. When the lever 9 is moved from the medium-position to off-position and released, it is returned to the off-position. When the lever 9 is at the on-position, the vent valve 5A is closed, and the pump contact 6A is moved down to the lowest position to perform suction. When the lever 9 is at the medium-position, the pump contact 6A is moved upward while the vent valve 5A is kept closed. When the lever 9 is at the off-position, the vent valve 5A is opened, and the engagement of the pump contact 6A and the projection 9A is released.

The output of the switch 11 and the shift position of the lever 9 are detected by a controller, as will be described later, and transferring of the connecting part 3, drive of the electro-magnetic valve 8, and so on are controlled.

Figure 4:
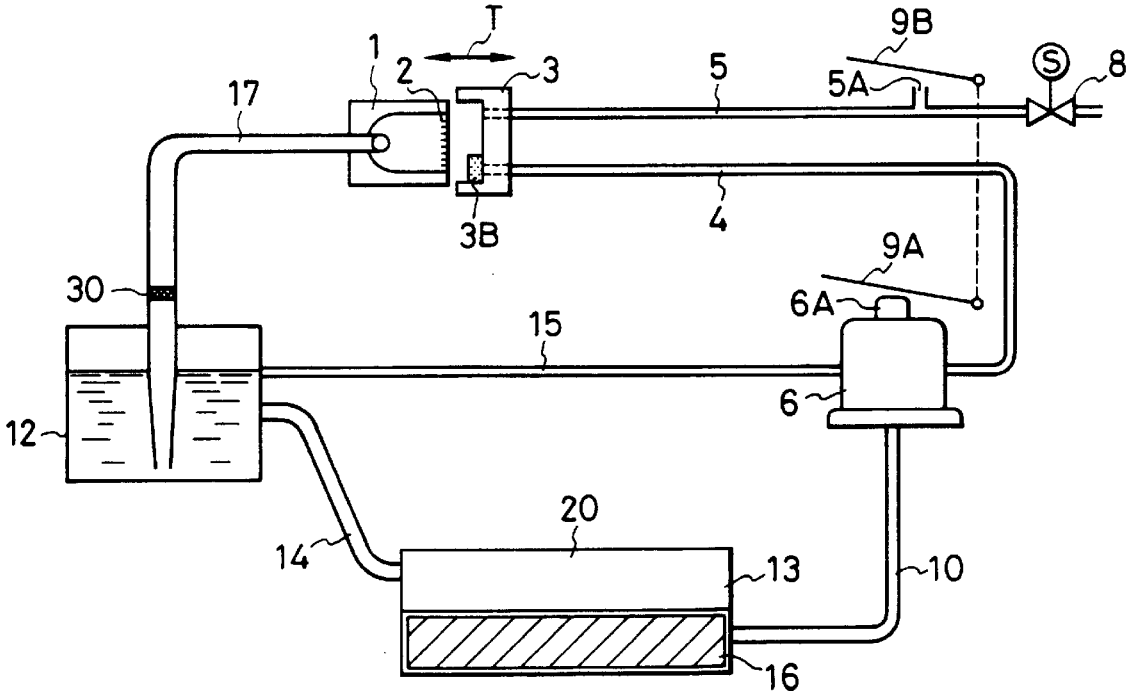
FIG. 4 is a schematic diagram of a main part of the apparatus according to an embodiment of the present invention, wherein air is introduced from outside a discharge port.

FIG. 4 shows an arrangement of a main part of the apparatus according to an embodiment of the present invention. In this embodiment, a pressure is externally supplied to the discharge port to introduce air into the recording head 1, and thereafter the pump 6 performs suction, thereby discharging the ink or performing an ink supply recovery process. When a pressure is supplied, the connecting part 3 is repeatedly connected to and detached from the head 1.

Referring to FIG. 4, a vent valve 5A is provided midway along the atmosphere open tube 5. The vent valve 5A is responsive to the operation of the operation lever 9 and can be closed by a portion 9B of the lever 9. An ink absorber 3B is provided in the cap 3A to hold the ink, and is made of a porous material having a liquid-absorbing property. Note that the cap 3A is generally made of a rubber material, such as a silicone rubber and butyl rubber.

A filter 30 is provided midway along the ink supply tube 17, for trapping foreign material, such as dust, in the supplied ink, thus prohibiting the foreign material from flowing to the recording head 1. A waste ink absorber 16 is arranged in the ink cartridge 13, for receiving the waste ink drawn by the pump 6 through a waste ink tube 10.

Figure 5:
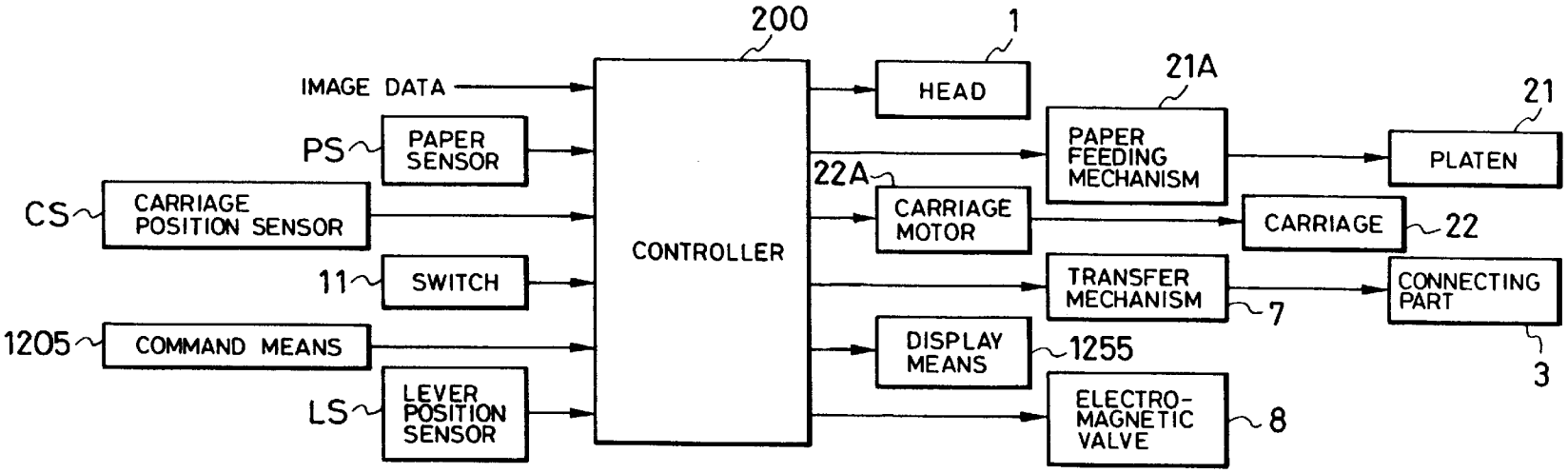
FIG. 5 is a block diagram of a control system of the embodiment shown in FIG. 4.

FIG. 5 shows an arrangement of a control system of the apparatus according to the embodiment shown in FIG. 4. A controller 200 is, e.g., a microcomputer having a CPU, a ROM, a RAM, and so on, controls the respective portions in accordance with the process sequence stored in the ROM, and drives the head 1 based on the image data received from a host unit or the like, thus performing recording. A paper sensor PS detects a recording sheet P. When the paper sensor PS detects a paper sheet, the controller 200 drives a platen roller 21 through a paper feeding mechanism 21A including a paper feed motor, thereby controlling paper feed operation. A carriage position sensor CS detects position of the carriage 22. The controller 200 drives the carriage 22 or controls positioning of the carriage 22 to a home position or the like through a carriage motor 22A in accordance with detected position data from the sensor CS.

A transfer mechanism 7 has, in addition to the gear 7A and the cam 7B, a drive member, such as a motor, for transferring the connecting part 3. The controller 200 positions the connecting part 3 with respect to the head 1 in accordance with a contact signal from the switch 11. A command means 1205 and a display means 1255 are provided on the operation panel shown in FIG. 1B. A position sensor LS detects the position of the lever 9 and can be arranged in association with, e.g., the pump contact 6A.

Figure 6A:
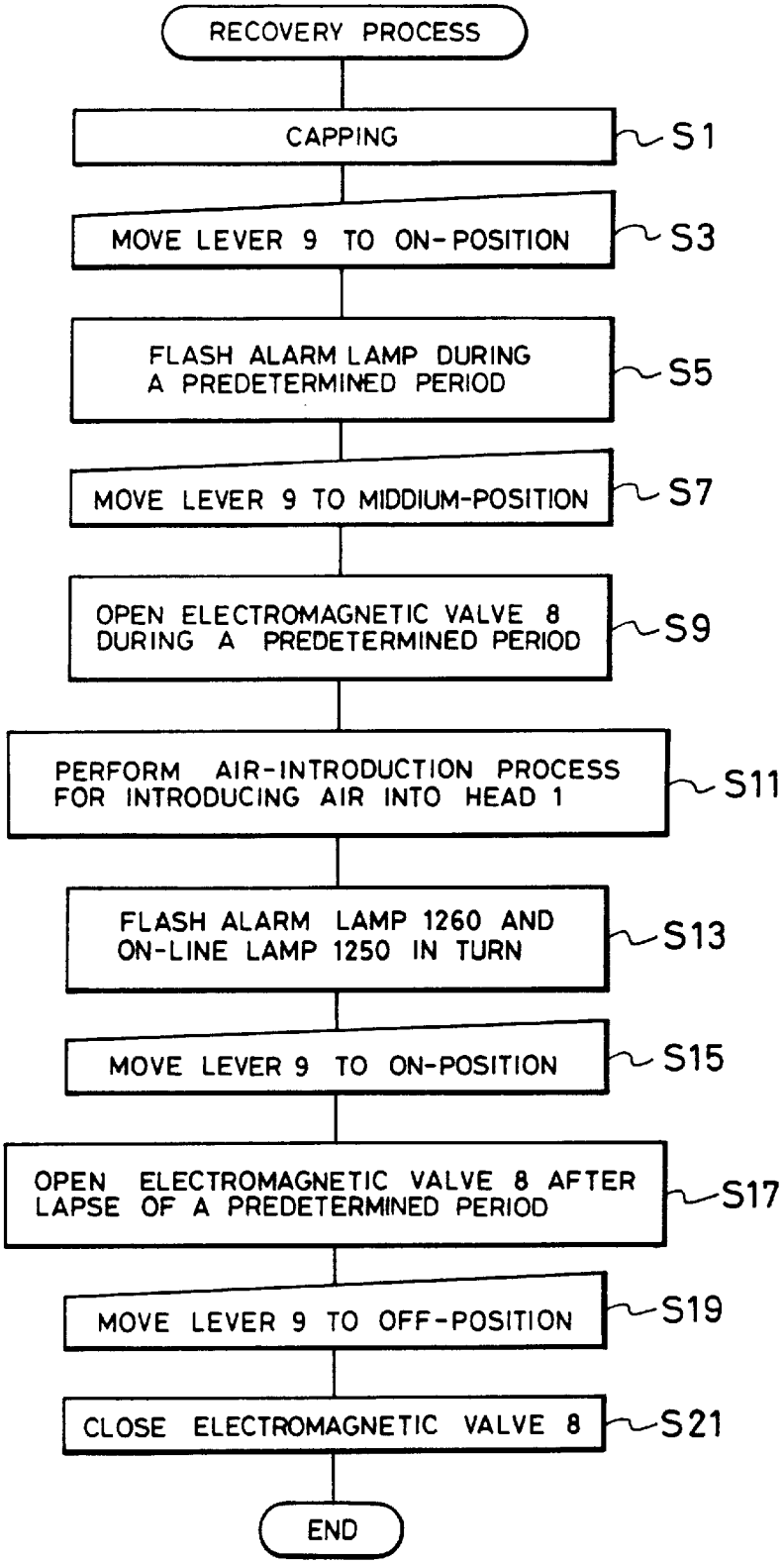
FIGS. 6A and 6B are flow charts..showing a recovery process sequence, respectively, of the control system shown in FIG. 5.
Figure 7:
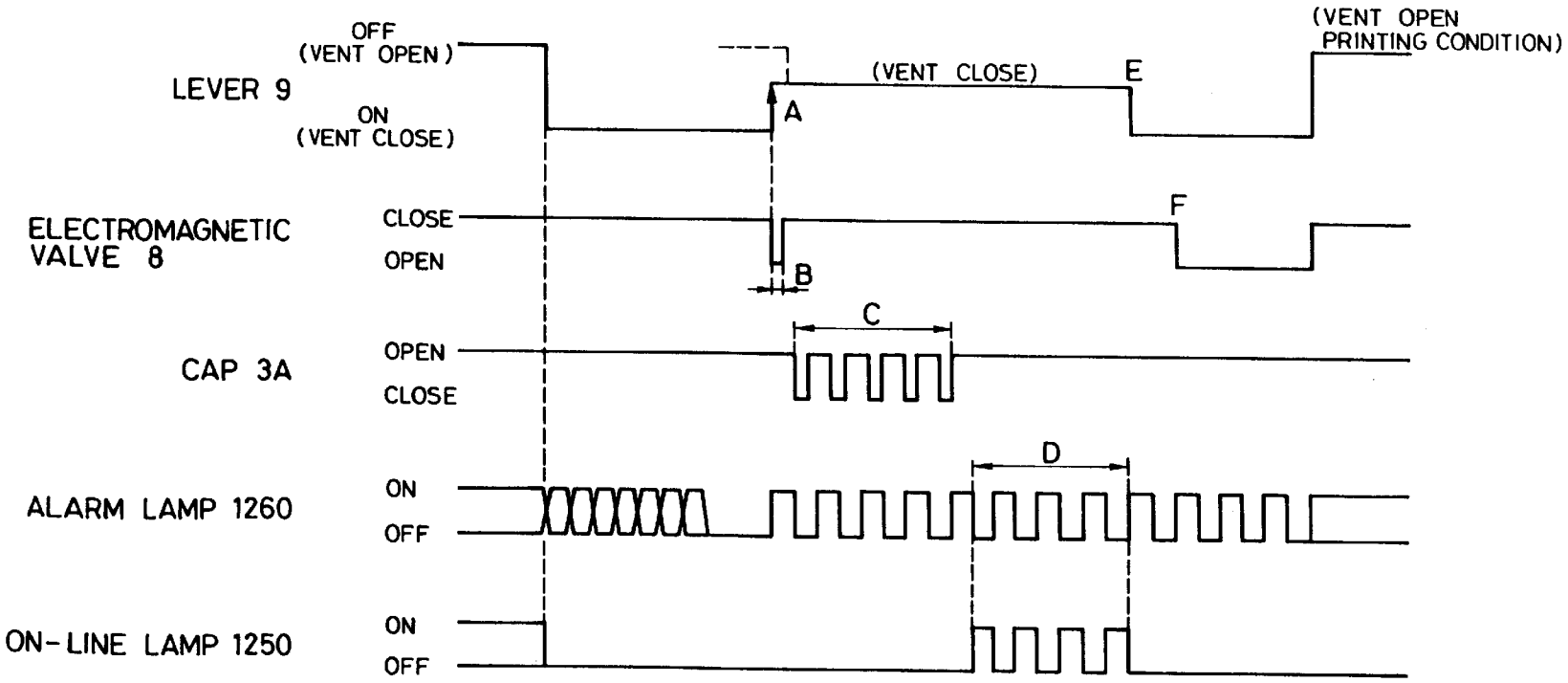
FIGS. 7 to 9 are timing charts showing operations of the respective portions in the recovery process.
Figure 8:
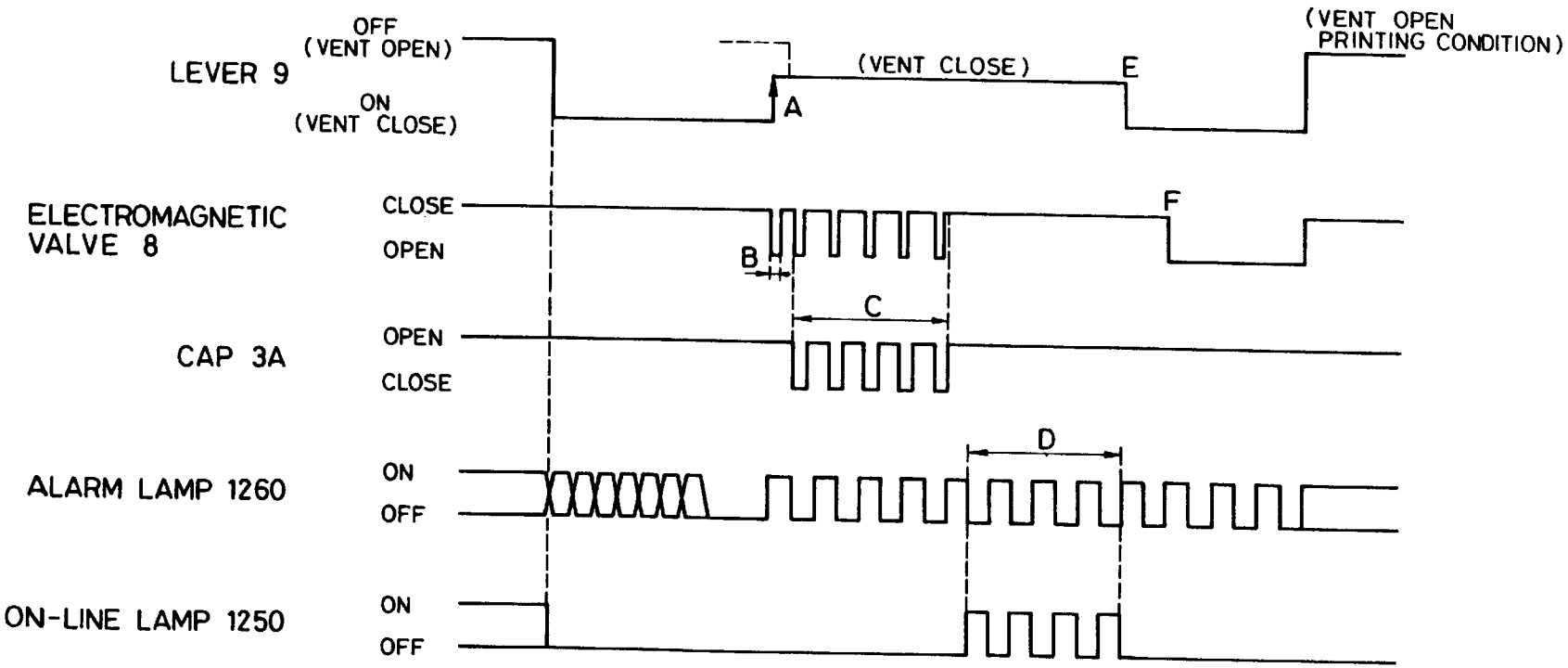
Figure 9:
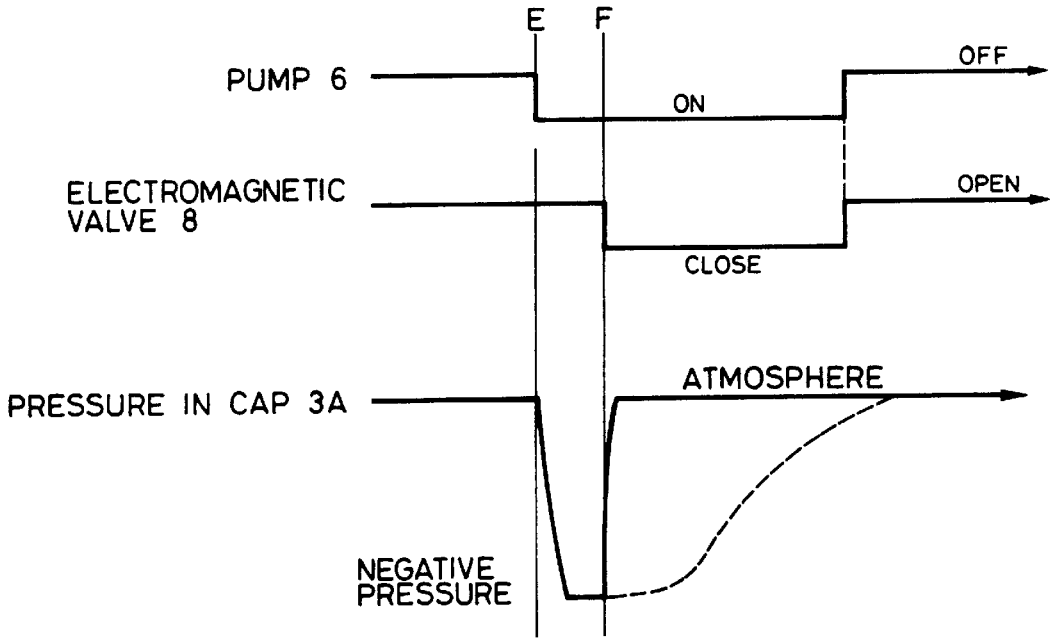

FIG. 6A shows a recovery process sequence by the controller 200 shown in FIG. 5; and FIG. 7 to 9 show operations of the respective sections for performing the recovery process.

First, assume that the carriage 22 is positioned at the home position by turning on of the power source or at an appropriate timing during recording process. Then, the connecting part 3 is moved to the head 1 in step S1 of FIG. 6A and performs capping. In this state, the operator moves the lever 9 from the off-position to on-position in step S3 (a time point A in FIG. 7), waits for a predetermined period in step S5 until flashing of the alarm lamp ends, and then releases the operation of the lever 9 in step S7. When the lever 9 is moved to the on-position, suction process from a discharge port 2 is performed, and ink fills the connecting part 3 and the suction tube 4. In this case, the electro-magnetic valve 8 is opened for a predetermined period (a period B in FIG. 7) in step S9 in order to prevent excessive ink filling.

Next, the connecting part carrying mechanism 7 is controlled in step S11 to repeat connection/disconnection of the cap 3A and the discharge port 2 several times (a period C of FIG. 7). In this case, air is supplied into the head 1 through the discharge port 2 by means of the elastic cap 3A. Ink fills the cap 3A and the tube 4 to reduce the volume of its free spaces, and filled ink serves as an elastic member. As a result, air is effectively introduced into the cap 3A and the tube 4. When the electro-magnetic valve 8 is opened only immediately before the cap 3A is disconnected from the discharge port 2 during the period C, as shown in FIG. 8, in synchronism with the air-introduction process of step S11, a negative pressure instantaneously generated in the connecting part 3 immediately before disconnection of the cap 3A can be removed. As a result, introduced air may not be discharged (forward movement of the meniscus) and the ink may not be scattered.

Subsequently, in step S13, the alarm and on-line lamps 1260 and 1250 are flashed in turn, so that they are used as an air introduction alarming means to inform the operator of the end of the air-introduction process. After the lapse of a period D, when the operator moves the lever 9 from the medium-position to on-position (a time point E) in step S15, the suction process is initiated, and the electro-magnetic valve 8 is opened after a predetermined period lapses (a time point F) in step S17. Then, the operator moves the lever 9 to the off-position in step S19, and the electro-magnetic valve 8 is closed in step S21.

In this case, air is introduced to the rear portion of the discharge port 2, i.e., in the head 1 and the supply tube 17. Thus, when negative pressure suction is performed in this state by the pump 6, air is discharged from the discharge port 2 at once, and a flow path resistance is substantially decreased, thereby providing a large suction force. Therefore, factors causing poor discharge in the ink supply path from the subtank 12 to the discharge port 2, i.e., a foreign material such as bubbles present in the filter 30 or in the corner or step of the supply path can be reliably removed.

Note that ink suction is performed and the cap 3A and the suction tube 4 are filled with ink in steps S3 to S7 so that an increased pressure, generated by connection of the cap 3A, reliably acts on the discharge port 2 during the air-introduction of the rear portion of the discharge port 2. Also, the timing for opening the electro-magnetic valve 8 in step S17 is delayed from the timing for moving the lever 9 to the on-position for the following reasons.

Assume that while the discharge port 2 is completely closed by the cap 3A and the vent and electro-magnetic valves 5A and 8 are closed, the pump 6 is turned on (operative state) at the time point E of FIGS. 7, 8, and 9. Then, suction is performed through the suction tube 4, a negative pressure (ink suction negative pressure) is generated in the cap 3A and the atmosphere open tube 5, and suction process from the discharge port 2 is performed.

In this case, the ink drawn from the discharge port 2 together with air fills the cap 3A and leaks from the ink absorber 3B. The ink can also fill the atmosphere open tube 5. This state, however, can adversely affect subsequent ink discharge.

In order to prevent this, in this embodiment, the electro-magnetic valve 8 is turned on (open state) at a time point F after a predetermined period laspes from the time point E, and the atmosphere open tube 5 is communicated with the atmosphere. Then, the ink leaking from the ink absorber 3B and in the atmosphere open tube 5 is supplied to the pump 6 through the suction tube 4.

As shown in FIG. 9, the pressure (suction pressure waveshape) in the cap 3A becomes a negative pressure with a slight transition delay angle at the time point E when the pump 6 is turned on, and is abruptly returned to the atmospheric pressure at a time point F when the electro-magnetic valve 8 is turned on (opened). Therefore, no ink suction is performed after the time point F.

The period (F–E) between the time point E at which the pump 6 is turned on and the time point F at which the electro-magnetic valve 8 is turned on can be controlled by the controller 200, or by a timer which controls opening/closing of the electro-magnetic valve 8. The period (F–E), i.e., the ink suction period can be arbitrarily changed by adjusting the controller 200 or the timer.

In the above embodiment, the lever 9 is manually operated by the operator. However, it can be operated quite easily by an appropriate command and drive means or by a drive means during control. When the lever 9 is manually operated, a start switch or the like which starts operation from the broken line in FIGS. 7 and 8 at the time point A can be provided, thus simplifying the recovery operation.

In this embodiment, pressurization for introducing air from the discharge port is performed by the cap 3A which prevents clogging of the nozzle or dust from being introduced to the supply path. However, a pressurization cap for introducing air from the discharge port 2 can be provided independently of the cap 3A.

If sufficient air is introduced by a single connection operation, repeated connection operation is not needed and only a single connection operation may be performed.

In the above embodiment, pressure is applied from outside the discharge port 2 to introduce air. However, air introduction can be performed by setting the interior of the discharge port 2 at a negative pressure.

Figure 6B:
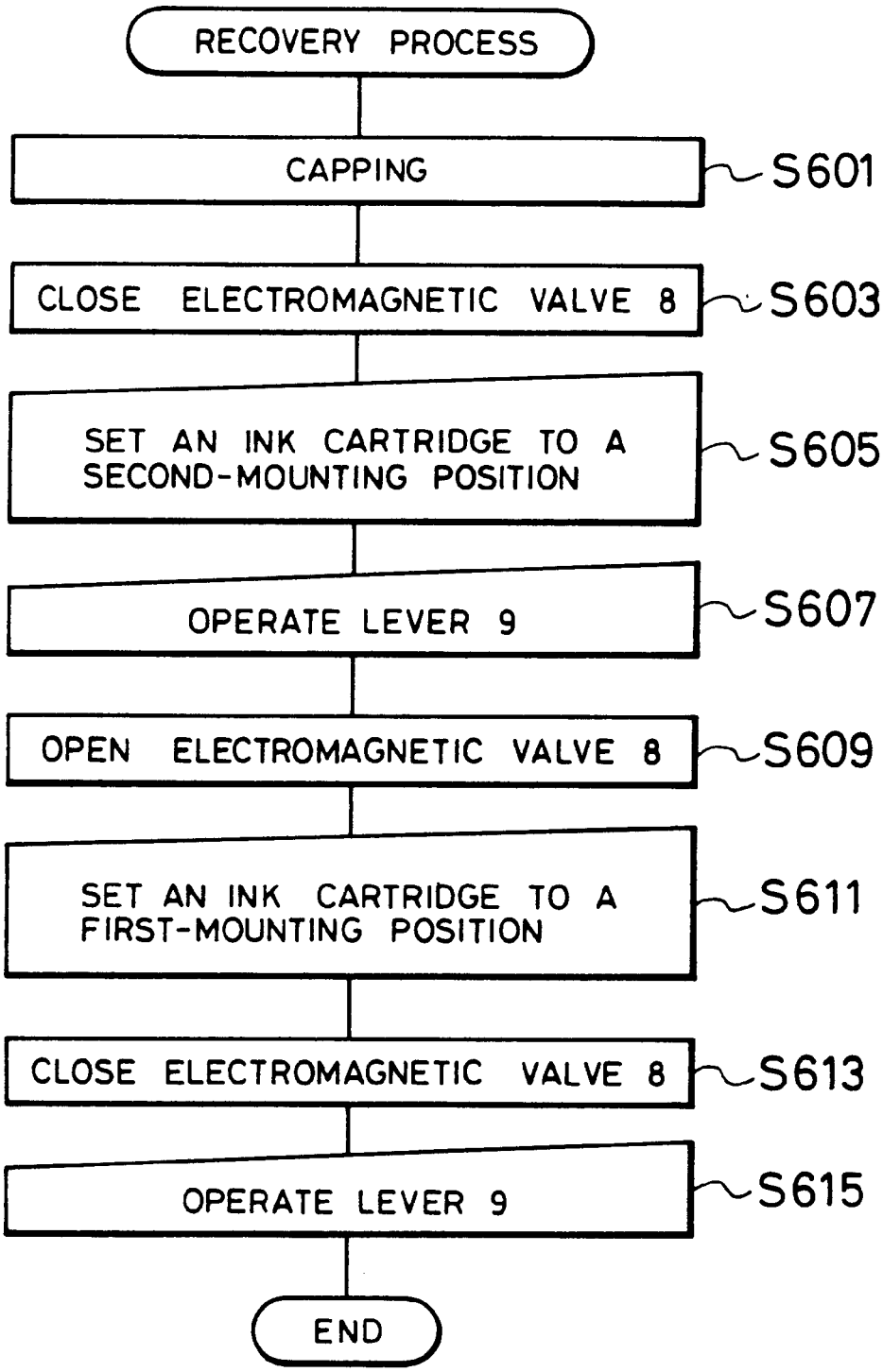

FIG. 6B shows another example of a recovery process sequence performed by the controller 200 shown in FIG. 5.

Assume that the carriage 22 is positioned at the home position when the power source is turned on or at an appropriate timing during recording process. Then, the connecting part 3 is moved toward the head 1 to perform capping in step S601. Subsequently, the electro-magnetic valve 8 is closed in step S603, and the ink cartridge 13 is positioned at a second mount position (a position for blocking the ink supply path) in order to block the ink supply path from the ink cartridge 13 in step S605.

In this state, the lever 9 is moved from the off-position to the on-position and is released in step S607. At this time, upon movement of the lever 9 to the on-position, the vent valve 5A is closed, and the interior of the ink supply path, extending from the interior of the cap 3A, the subtank 12, to the discharge port 2, is set at a negative pressure through the suction tube 15. Then, the electro-magnetic valve 8 is opened to draw air from the discharge port 2 through the atmosphere open tube 5 in step S609. Subsequently, the ink cartridge 13 is positioned at a first position (a position for communicating the supply path) in step S611, the electro-magnetic valve 8 is closed in step S613, and the lever 9 is moved from the medium-position to off-position in step S615, thereby initiating the suction process.

In this case, air is introduced to the rear portion of the discharge port 2, i.e., in the head 1 and the supply tube 17. Thus, when negative pressure suction is performed in this state by the pump 6, air is discharged from the discharge port 2 at once, and a flow path resistance is substantially decreased, thereby providing a large suction force. Therefore, factors causing poor discharge in the ink supply path from the subtank 12 to the discharge port 2, i.e., a foreign material such as bubbles present in the filter 30 or in the corner or step of the supply path can be reliably removed.

Figure 10:
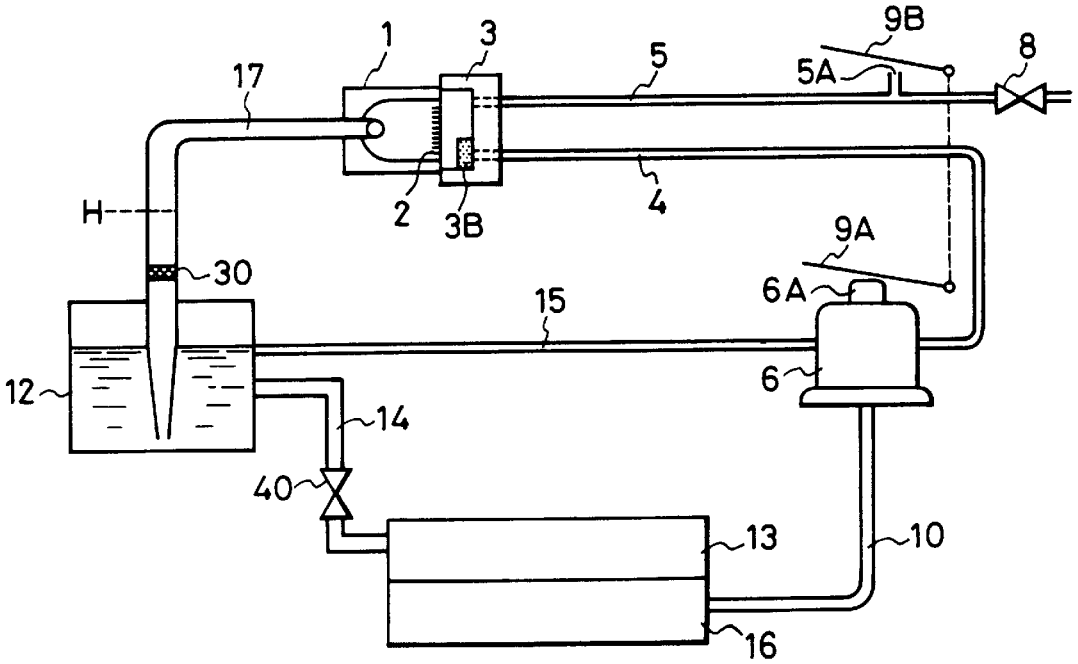
FIG. 10 is a schematic diagram of a main part of the apparatus according to another embodiment of the present invention.

FIG. 10 shows another embodiment of the main part of the present invention. Referring to FIG. 10, a control means 40 is arranged midway along a supply path 14, for blocking or decreasing an ink supply, and can be, e.g., an electro-magnetic valve. In this embodiment, when the electro-magnetic valve 40 is closed and a pump 6 is operated in this state, a supply path extending from a subtank 12 to a discharge port 2 is set at a negative pressure, thus enabling ink suction from the discharge port 2.

Referring to FIG. 10, a vent valve 5A is provided midway along an atmosphere open tube 5. The vent valve 5A is responsive to the operation of an operation lever 9 and can be closed by a portion 9B of the lever 9. An ink absorber 3B is provided in a cap 3A to hold the ink, and is made of a porous material having a liquid-absorbing property. Note that the cap 3A is generally made of a rubber material, such as a silicone rubber and butyl rubber.

A filter 30 is provided midway along an ink supply tube 17, for trapping a foreign material, such as dust, in the supplied ink, thus prohibiting the foreign material from flowing to a recording head 1. A waste ink absorber 16 is arranged in the cartridge 13, for receiving the waste ink drawn by the pump 6 through a waste ink tube 10.

Figure 11:
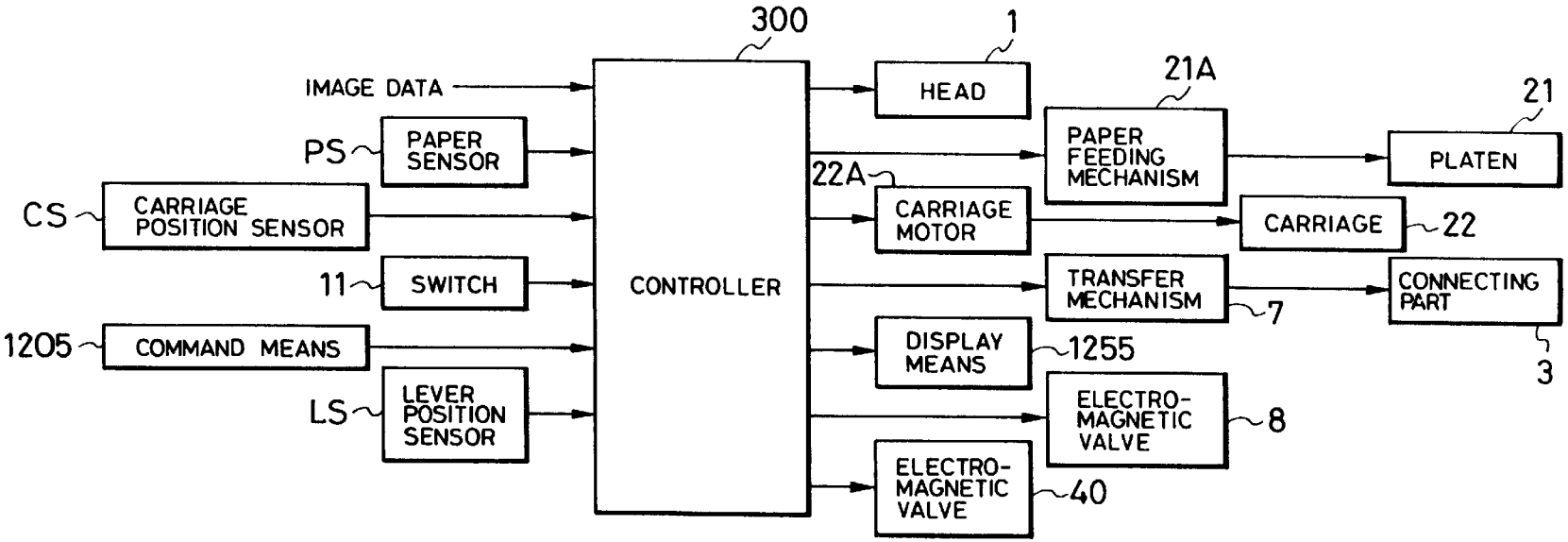
FIG. 11 is a block diagram of a control system of the embodiment shown in FIG. 11.

FIG. 11 shows an arrangement of a control system of the apparatus according to the embodiment shown in FIG. 10. A controller 300 is, e.g., a microcomputer having a CPU, a ROM, a RAM, and so on, controls the respective portions in accordance with the process sequence stored in the ROM, and drives the head 1 based on the image data received from a host unit or the like, thus performing recording. A paper sensor PS detects a recording sheet P. When the paper sensor PS detects a paper sheet, the controller 300 drives a platen roller 21 through a paper feeding mechanism 21A including a paper feed motor, thereby controlling paper feed operation. A carriage position sensor CS detects position of the carriage 22. The controller 300 drives the carriage 22 or controls positioning of the carriage 22 to a home position or the like through a carriage motor 22A in accordance with detected position data from the sensor CS.

The controller 300 uses a carrying mechanism 7 having, in addition to a gear 7A and a cam 7B, a drive member, such as a motor, for transferring a connecting part 3. With the carrying mechanism 7, the controller 300 positions the connecting part 3 with respect to the head 1 in accordance with a contact signal from a switch 11. Command and display means 1205 and 1255 are provided on the operation panel shown in FIG. 1B. A position sensor LS can be arranged to operated in association with the lever 9 or a pump contact 6A. Furthermore, the controller 300 controls opening/closing of an electro-magnetic valve 40 during a recovery process.

Figure 12:
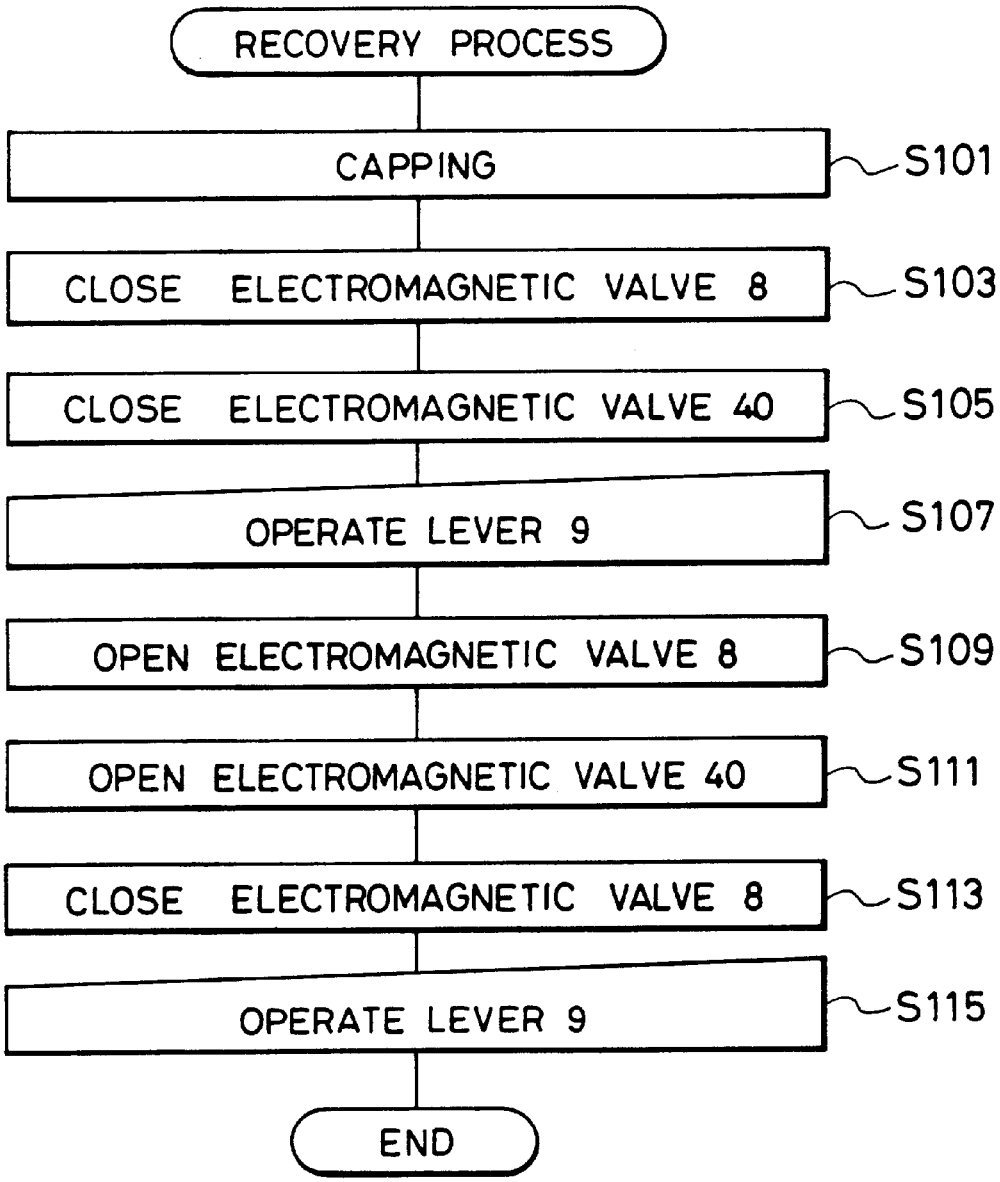
FIG. 12 is a flow chart showing a recovery process sequence of the control system shown in FIG. 11.

FIG. 12 shows another example of a recovery process sequence performed by the controller 300 shown in FIG. 11.

Assume that the carriage 22 is positioned at the home position when the power source is turned on or at an appropriate timing during recording process. Then, the connecting part 3 is moved toward the head 1 to perform capping in step S101. Subsequently, the electro-magnetic valve 8 is closed in step S103, and the electro-magnetic valve 40 is closed in order to block the ink supply path from the ink cartridge 13 in step S103.

In this state, the lever 9 is moved from the off-position to the on-position and is released in step S107. At this time, upon movement of the lever 9 to the on-position, a vent valve SA is closed, and the interior of the ink supply path, extending from the interior of the cap 3A, the subtank 12, to the discharge port 2, is set at a negative pressure through the suction tube 15. Then, the electro-magnetic valve 8 is opened to draw air from the discharge port 2 through an atmosphere open tube 5 in step S109. Subsequently, the electro-magnetic valves 40 and 8 are opened and closed in steps S111 and S113, respectively, and the lever 9 is moved from the medium-position to off-position in step S115, thereby initiating suction process.

In this case, air is introduced to the rear portion of the discharge port 2, i.e., in the head 1 and the supply tube 17. Thus, when negative pressure suction is performed in this state by the pump 6, air is discharged from the discharge port 2 at once, and a flow path resistance is substantially decreased, thereby providing a large suction force. Therefore, factors causing poor discharge in the ink supply path from the subtank 12 to the discharge port 2, i.e., a foreign material such as bubbles present in the filter 30 or in the corner or step of the supply path can be reliably removed.

Figure 13:
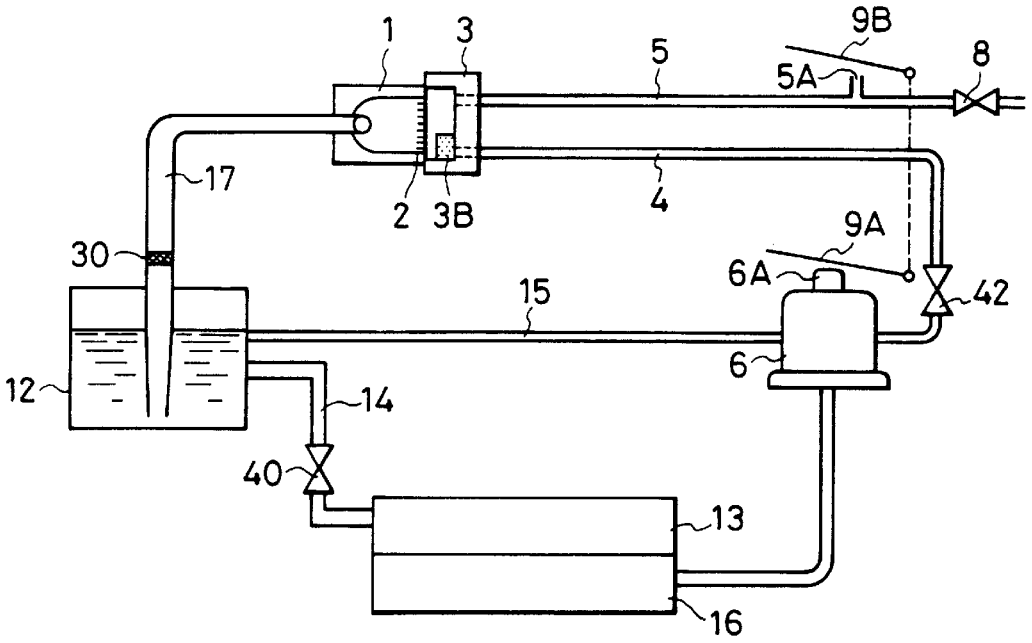
FIGS. 13 to 16 are schematic diagrams of four examples of the present invention wherein the interior of a discharge port is set at a negative pressure and air is taken from the discharge port.

As shown in FIG. 13, an opening/closing means 42 for a suction path, such as an electro-magnetic valve, which can be controlled by the controller, can be provided midway along the suction tube 4 in addition to the electro-magnetic valve 40, and the air-introduction process can be performed thereby.

More specifically, for example, when the electro-magnetic valve 40 is closed and thereafter the electro-magnetic valves 8 and 42 are opened and closed, respectively, in order to operate the pump 6, a large negative pressure is generated in the head 1 through the tube 15. As a result, the ink in the head 1 is caused to flow inversely to the subtank 12 through the supply tube 17, and air is drawn from the discharge port 2.

Thereafter, the electro-magnetic valves 40 and 42 are opened and the electro-magnetic valve 8 is closed, respectively, and the pump 6 is operated in this state, thereby obtaining the same effect as that described above.

Figure 14:
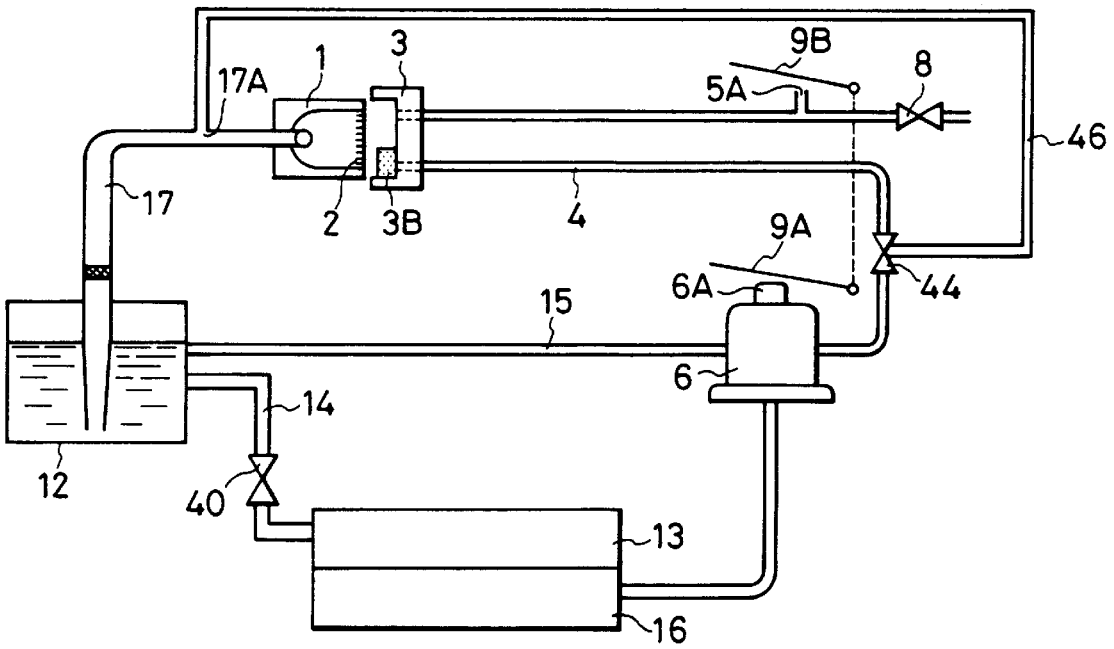

As shown in FIG. 14, a three-way valve 44 can be provided midway along the suction tube 4 in addition to the electro-magnetic valve 40, and a bypass tube 46 for communicating the three-way valve 44 and an intermediate portion, e.g., a portion 17A, of the supply tube 17 can be provided. In this case, the three-way valve 44 is appropriately switched to select the suction tube 4 side or the bypass tube 46 side as the suction path, thus performing air-introduction process.

More specifically, for example, assume that the electro-magnetic valves 40 and 8 are closed and opened, respectively, thereafter the suction path is switched to the bypass tube 46 side by the three-way valve 44, and the pump 6 is operated in this state. Then, air can be drawn from the discharge port 2 to at least the portion 17A.

Then, when the electro-magnetic valves 40 and 8 are opened and closed, respectively, and the three-way valve 44 is switched to the suction tube 4 side, thus operating the pump 6, the same effect as that described above can be obtained.

Figure 15:
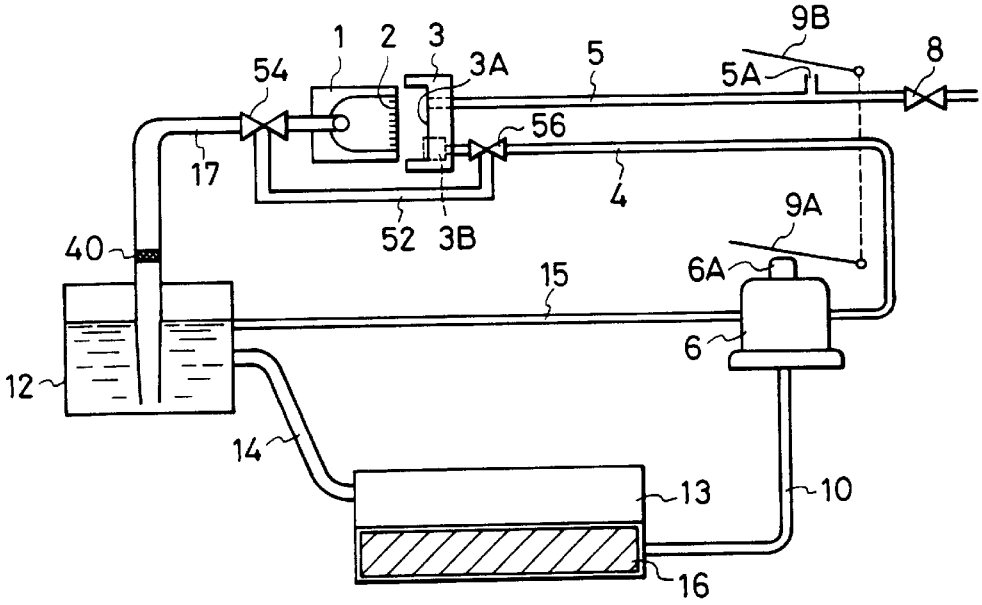

Furthermore, as shown in FIG. 15, a communication tube 52 which communicates the supply tube 17 with the suction tube 4 can be provided. In this case, a three-way valve 54 can be provided to the connecting port of the communication tube 52 with the supply tube 17. The three-way valve 54 can be switched between a position for communicating the subtank 12 side with the head 1 side and a position for communicating the communication tube 52 side with the head 1 side. A three-way valve 56 can also be provided at a connecting port of the communication tube 52 with the suction tube 4. The three-way valve 56 can be switched between a position for communicating the connecting part 3 side with the pump 6 side and a position for communicating the communication tube 52 side and the pump 6 side. Air-introduction process can be performed with this arrangement.

More specifically, the three-way valve 54 is normally set in a state to communicate the subtank 12 with the printing head and hence enable ink supply to the head 1, and the three-way valve 56 is set in a state to communicate the three-way valve 56 with the part 3 and the pump 6.

For a recovery process, the three-way valve 54 is switched to the position for communicating the head 1 with the communication tube 52, and the three-way valve 56 is set at the position for communicating the communication tube 52 with the pump 6. In other words, the head 1 is allowed to communicate with the pump 6 by the two three-way valves through part of the supply tube 17, the communication tube 52, and the suction tube 4.

In this state, when the pump 6 is operated while the connecting part 3 is kept detached from the head 1 or while the electro-magnetic valve 8 is opened and the cap 3A is kept connected to the head 1, the ink in the head 1 is drawn by suction from the supply tube side, and air is drawn into the head 1 from the discharge port 2.

Subsequently, when the three-way valves 54 and 56 are returned to normal states and the recovery operation is performed in a similar manner to that described above, the same effect as described above can be obtained.

In the embodiments shown in FIGS. 10 to 15, the pump 6 also serves as a negative pressure generation means for introducing air into the head 1. However, another negative pressure generation means can also be used instead.

Figure 16:
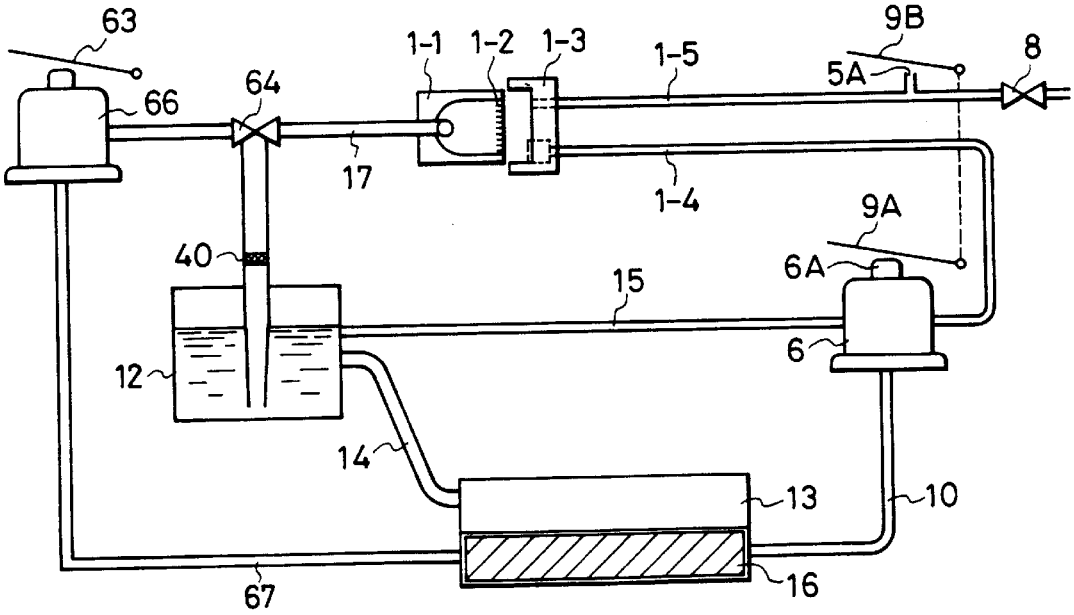

FIG. 16 shows an example of another negative pressure generation means. Referring to FIG. 16, a three-way valve 64 is provided midway along the supply tube 17, and is communicated with a waste ink absorber 16 through a pump 66 as a negative pressure generation means and a waste ink tube 67. The three-way valve 64 can define a path for communicating the head 1-1 side with the pump 66 side. An operation lever 63 is a lever for operating the pump 66.

With this arrangement, the three-way valve 64 normally communicates the subtank 12 with the head 1 so as to maintain the ink supply enabled state. When a recovery process is performed, the three-way valve 64 is switched to a position for communicating the head 1-1 with the pump 66, and the pump 66 is operated by the operation lever 63 so as to generate a negative pressure, thus drawing air from the discharge port 2 into the head 1-1. In this case, the connecting part 1-3 is kept in a state detached from the head X, or the electro-magnetic valve 8 is opened and the connecting part 1-3 is kept in a state connected to the head 1-1.

The ink drawn by the pump 66 is recovered by the waste ink absorber 16 in the ink tank 13 through the waste ink tube 67. Then, the three-way valve 64 is returned to a normal state, and a recovery process similar to that described above may be performed.

In the embodiments shown in FIGS. 10 to 16, when a negative pressure is generated inside the discharge or 1-2 and air is introduced from the discharge or 1-2, an electro-magnetic or three-way valve is provided at an appropriate position in the ink supply path. This valve is arbitrarily switched to perform recovery process. However, considering that ink is supplied when the hollow needle 18 is thrusted into the elastic plug 19 of the ink bag 20, the recovery process can also be performed in the following manner.

Figure 17A:
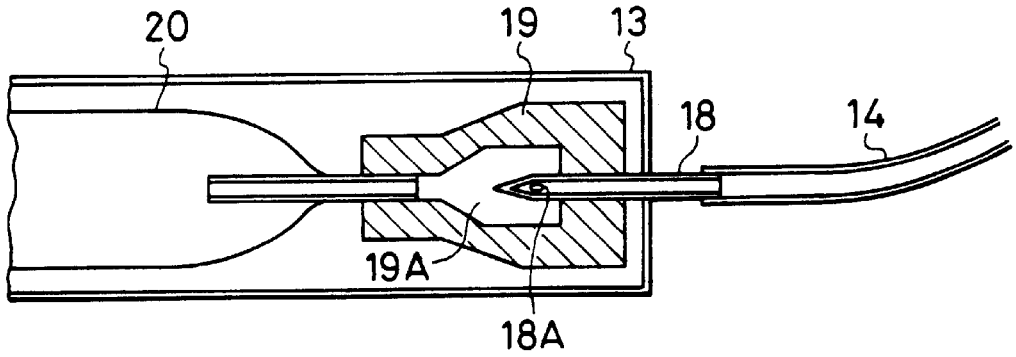
FIGS. 17A and 17B are sectional views showing a connection state of an ink supply tube and an ink cartridge.
Figure 17B:
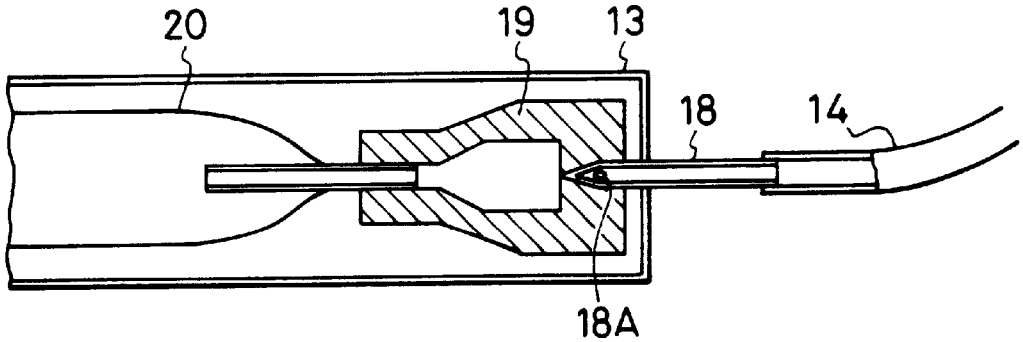

FIGS. 17A and 17B show examples, respectively, of the connection between the supply tube 14 and the ink cartridge 13. Normally, a needle hole 18A of the needle 18 is inserted into a space 19A in the plug 19 of the ink bag 20, thus allowing communication of the ink. In contrast to this, when the recovery process is performed, if the positional relationship of the ink cartridge 13 and the needle 18 is set such that the needle hole 18A of the needle 18 is positioned in the elastic member of the plug 19, as shown in FIG. 17B, the needle hole 18A is closed by the plug 19.

FIGS. 18 to 21 show examples of an apparatus wherein position setting shown in FIG. 17 can be performed.

Figure 18A:
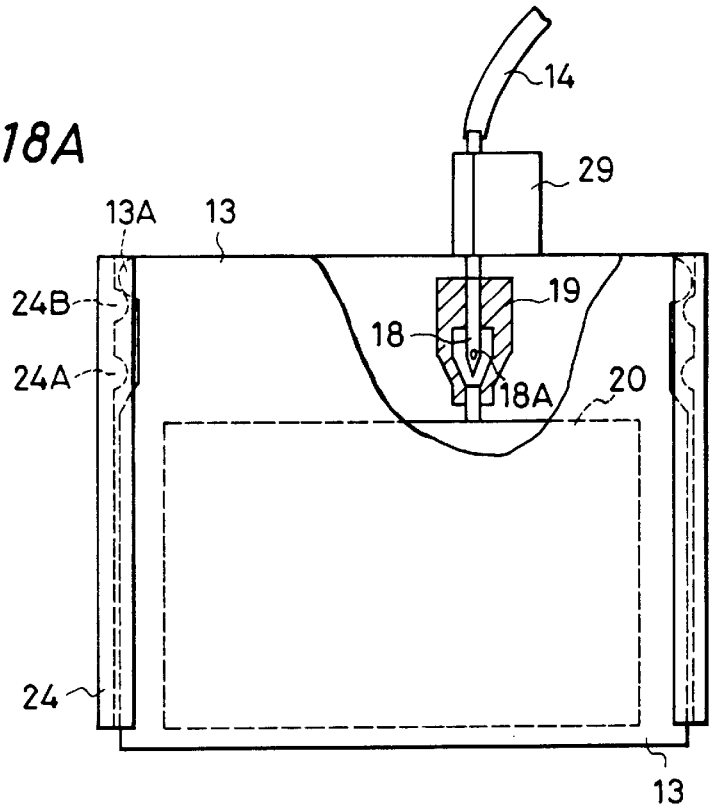
Figure 18B:
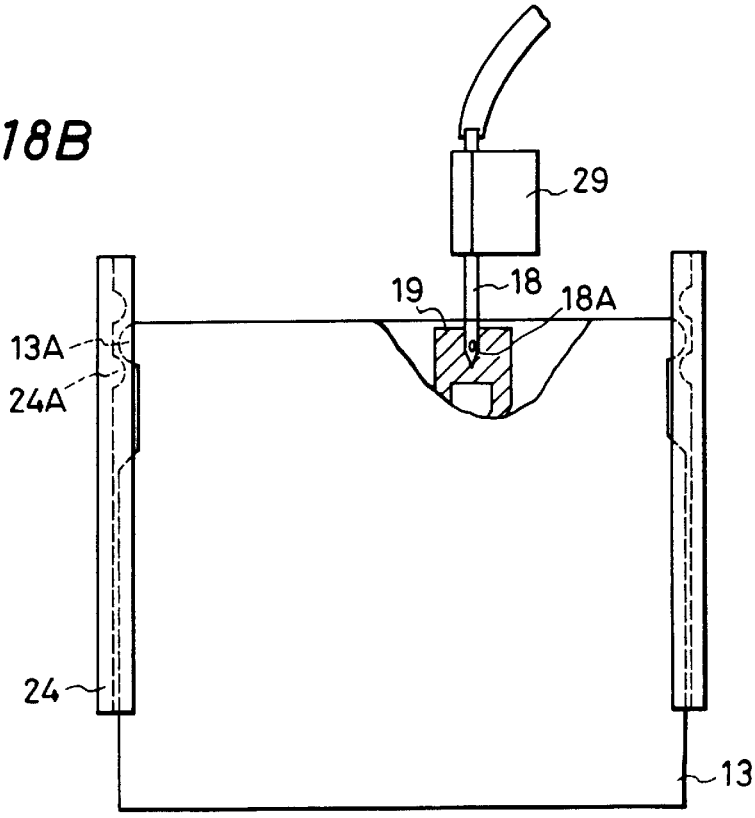

Referring to FIGS. 18A and 18B, click points 24A and 24B are provided to an engagement guide 24 of the apparatus main body 1000 which receives the ink cartridge 13. The click points 24A and 24B hold the ink cartridge 13 at two positions, i.e., a position (second mount position) for blocking the supply path, and a position (first mount position) for communicating the supply path. A stop portion 13A is provided for the ink cartridge 13 to be stopped by the click points 24A and 24B. A needle position fix member 29 is fixed to the main body 1000.

With this arrangement, when the ink cartridge 13 is positioned by the operator or by a given drive means in association with the recovery process, an ink block state (FIG. 18B) by the click point 24A or a communication state (FIG. 18A) by the click point 24B can be obtained.

Figure 19A:
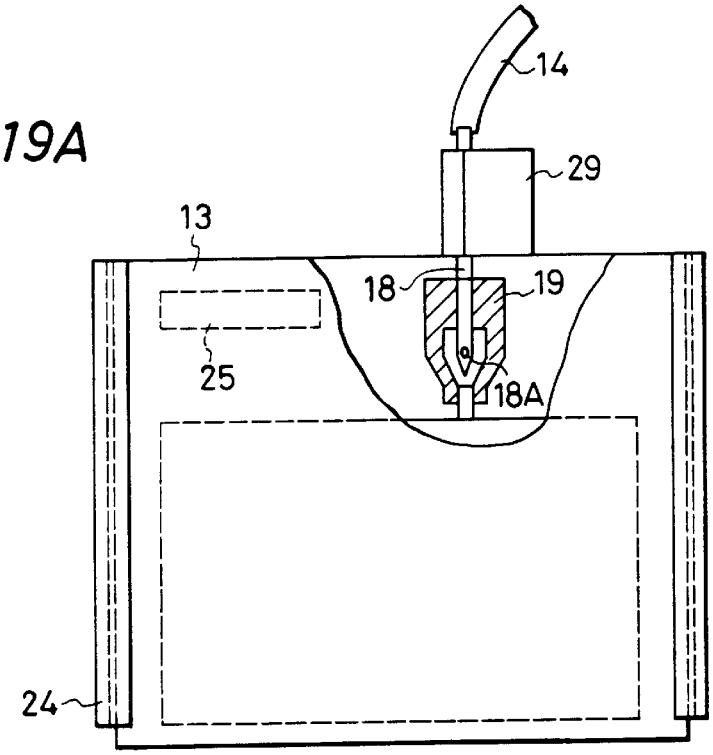
Figure 19B:
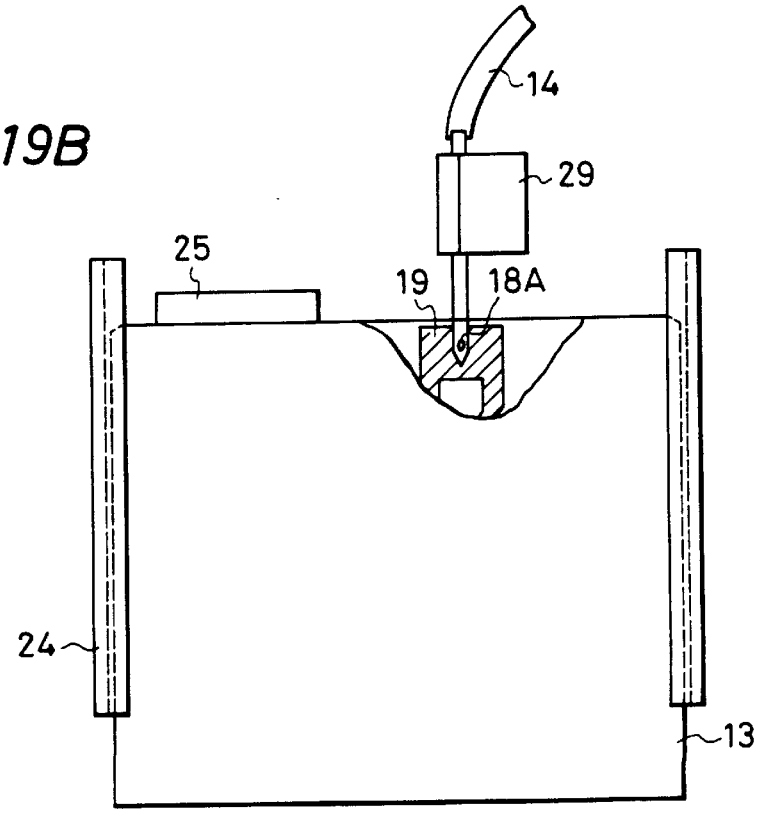

Referring to FIGS. 19A and 19B, a vertically movable stopper 25 is provided under a portion of an engagement path with the ink cartridge 13. When the stopper 25 is at a lower position, an ink communication state (FIG. 19A) can be obtained; when the stopper 25 is at an upper position, an ink block state (FIG. 19B) can be obtained. Note that the stopper 25 can also be provided at an appropriate portion other than the engagement path, e.g., the engagement guide 24.

Figure 20A:
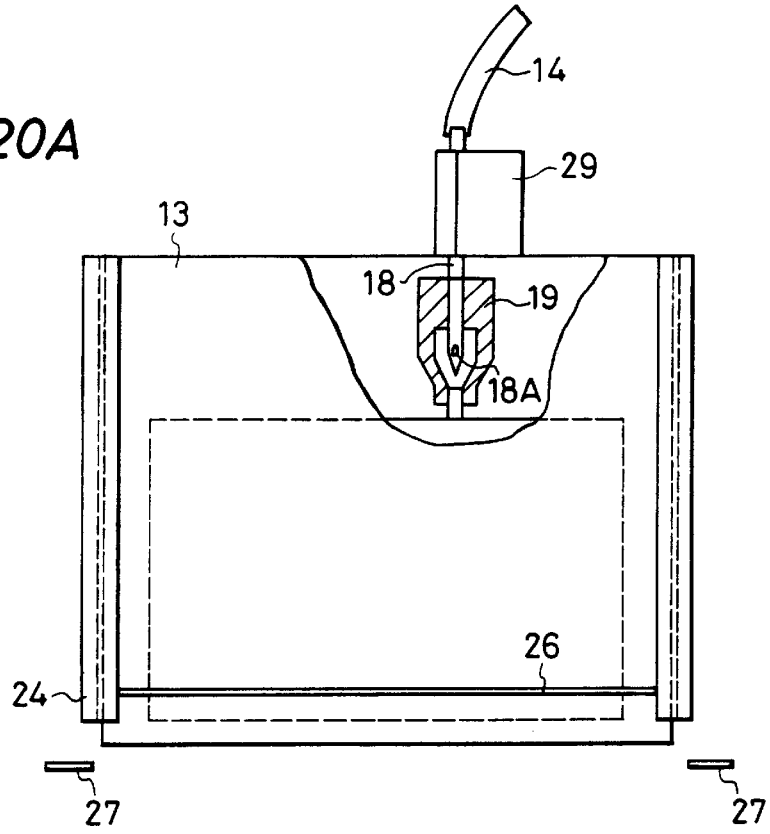
Figure 20B:
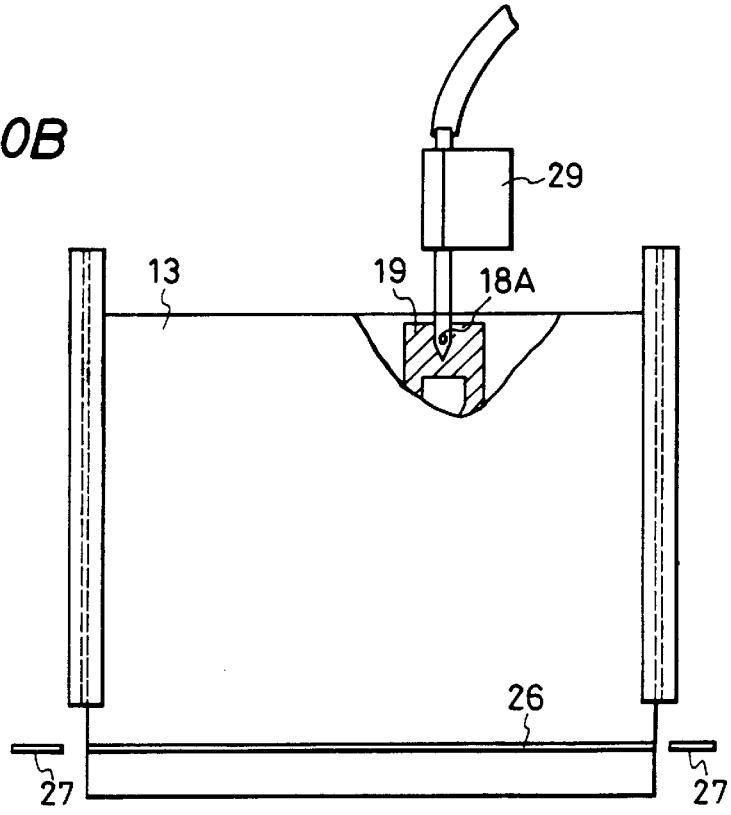

Referring to FIGS. 20A and 20B, when an alignment mark 26 provided on the ink cartridge 13 is aligned with an alignment mark 27 provided in the vicinity of the engagement portion of the main body 1000, an ink block state (FIG. 20B) is thus obtained. If the marks are not aligned with each other and the needle 18 is engaged at the deepest portion of the ink cartridge 13, a communication state as shown in FIG. 20A can be obtained.

Position setting can be performed by aligning the main body side mark and the end of the cartridge 13.

Figure 21A:
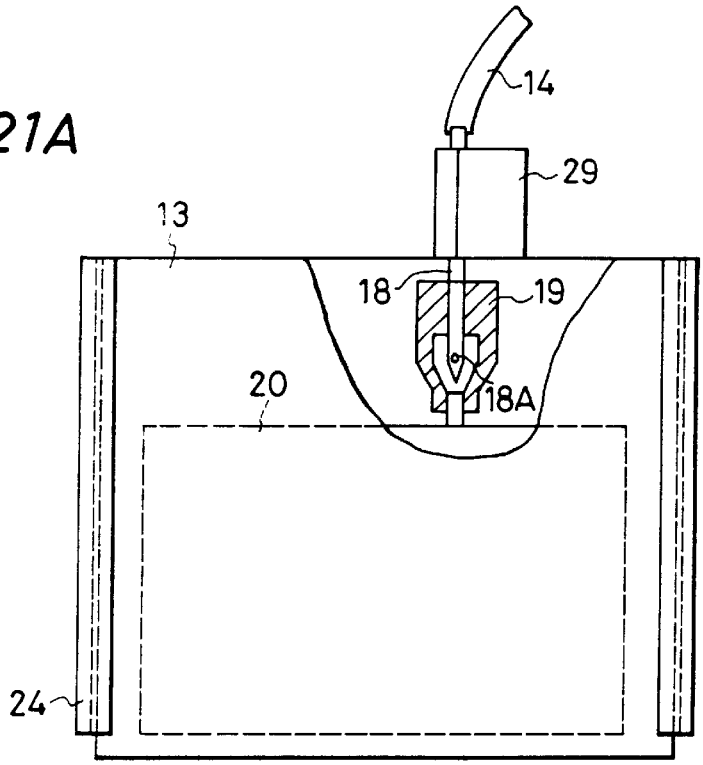
Figure 21B:
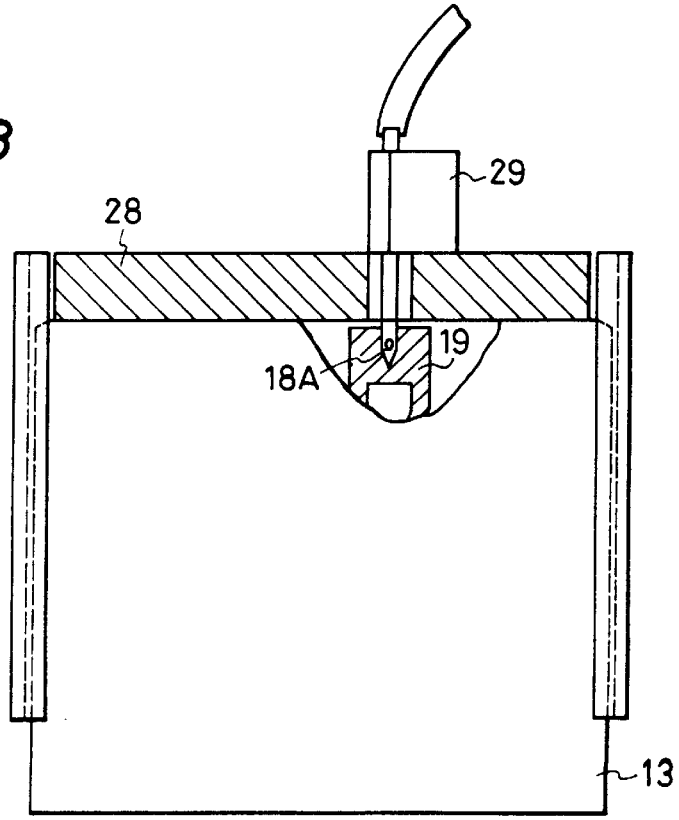

FIGS. 21A and 21B show an example wherein an attachment 28 is detachably provided to the ink cartridge 13, thereby performing positioning. When the attachment 28 is attached, the block state (FIG. 21B) can be obtained; when the attachment 28 is detached, the communication state (FIG. 21A) can be obtained.

In the examples shown in FIGS. 17 to 21, the ink supply path can be reliably blocked with considerable ease. These examples can be widely applied to a unit for performing ink suction from outside the discharge port 2, as well as to a unit for performing a recovery process by pressurizing the interior of the discharge port and ejecting the ink.

In the above examples, air is introduced from outside the discharge port 2. However, since the discharge port 2 has a large flow path resistance, as described above, air-introduction process may not be performed quickly in some cases. In order to prevent this, in FIGS. 22A, 22B, and 22C, a front surface 1A of the head 1 is arranged in the following manner.

Figure 22A:
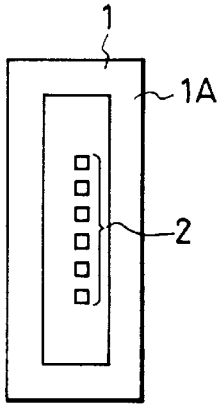
FIGS. 22A, 22B, and 22C are front views of three examples of the head front surface arrangement.
Figure 22B:
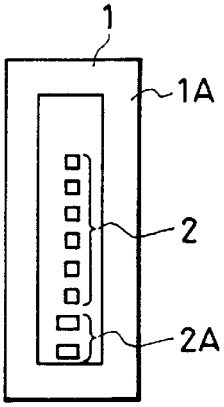
Figure 22C:
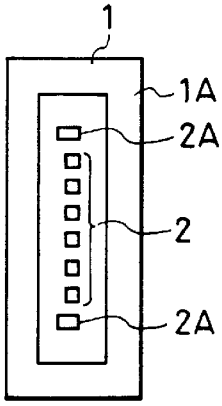

FIGS. 22A, 22B, and 22C show three examples of the arrangement of the head front surface 1A. FIG. 22A shows an example of a general arrangement of the head front surface 1A. This arrangement can be adopted when air-introduction process need not be performed quickly. When a quick, reliable air-introduction process must be performed, however, a dummy discharge port 2A having a larger sectional area than the discharge port 2 but not used for actual recording may be provided, as shown in FIGS. 22B and 22C.

More specifically, the tension force of the meniscus at a discharge port is defined by a surface tension. Therefore, the larger the sectional area (a radius r if the discharge port is circular), the smaller the tension force of the meniscus, and the easier it is to draw air when a positive or negative air pressure is to be introduced. Note that the number or positions of the dummy discharge ports 2A can be arbitrarily selected as required.

In the above examples, the exterior of the discharge port is pressurized or the interior thereof is evacuated, and air is introduced through the discharge port. However, air introduction can be performed in the following manner.

Figure 23:
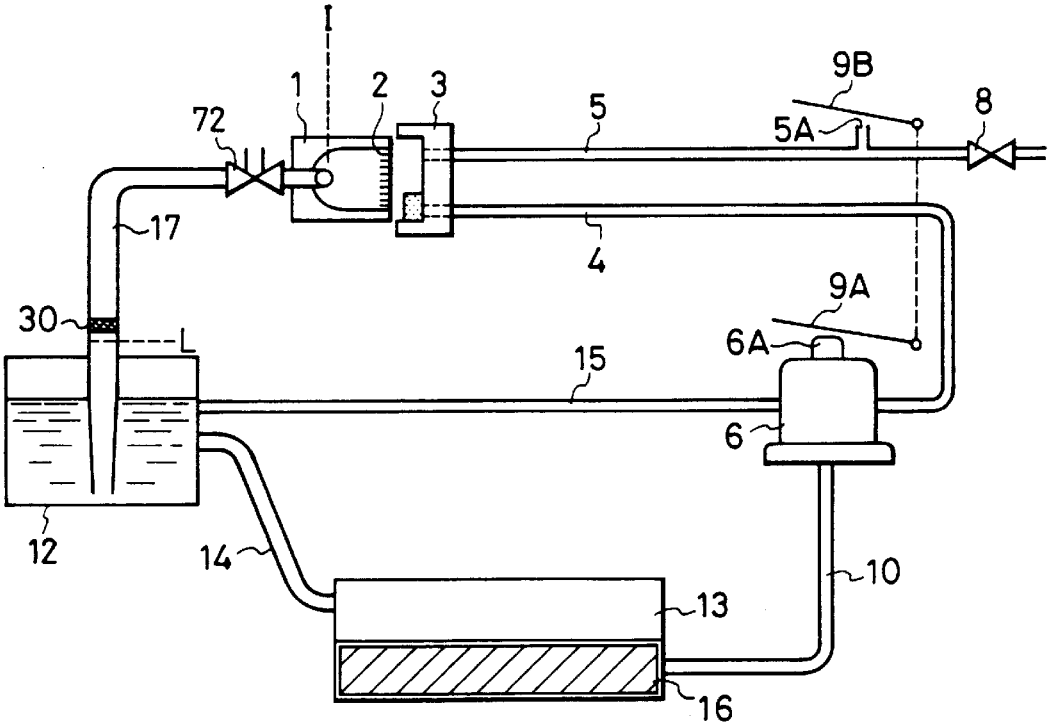
FIG. 23 is a schematic diagram of a main part of the apparatus according to still another embodiment of the present invention.

FIG. 23 shows an example of a main part of the apparatus according to still another embodiment of the present invention. In this case, a three-way valve 72 is arranged midway along an ink supply tube 17, e.g., a position of the supply tube 17 closer to the discharge port 2, i.e., at an intermediate position between a head 1 and a filter 30, and the interior of the supply tube 17 is opened to the atmosphere. Usually, the atmosphere side of the three-way valve 72 is closed, and the supply tube 17 can supply the ink to the nozzle.

An atmosphere open valve 5A is provided midway along an atmosphere open tube 5. The atmosphere open valve 5A is responsive to the operation of an operation lever 9 and can be closed by its portion 9B. An ink absorber 3B is provided in a cap 3A to hold the ink, and is made of a porous material having a liquid-absorbing property. Note that the cap 3A is generally made of a rubber material, such as a silicone rubber and butyl rubber.

The filter 30 is provided midway along the ink supply tube 17, for trapping a foreign material, such as dust, in the supplied ink, thus prohibiting the foreign material from flowing to the recording head 1 side. A waste ink absorber 16 is arranged in a cartridge 13, for receiving the waste ink drawn by the pump 6 through a waste ink tube 10.

Figure 24:
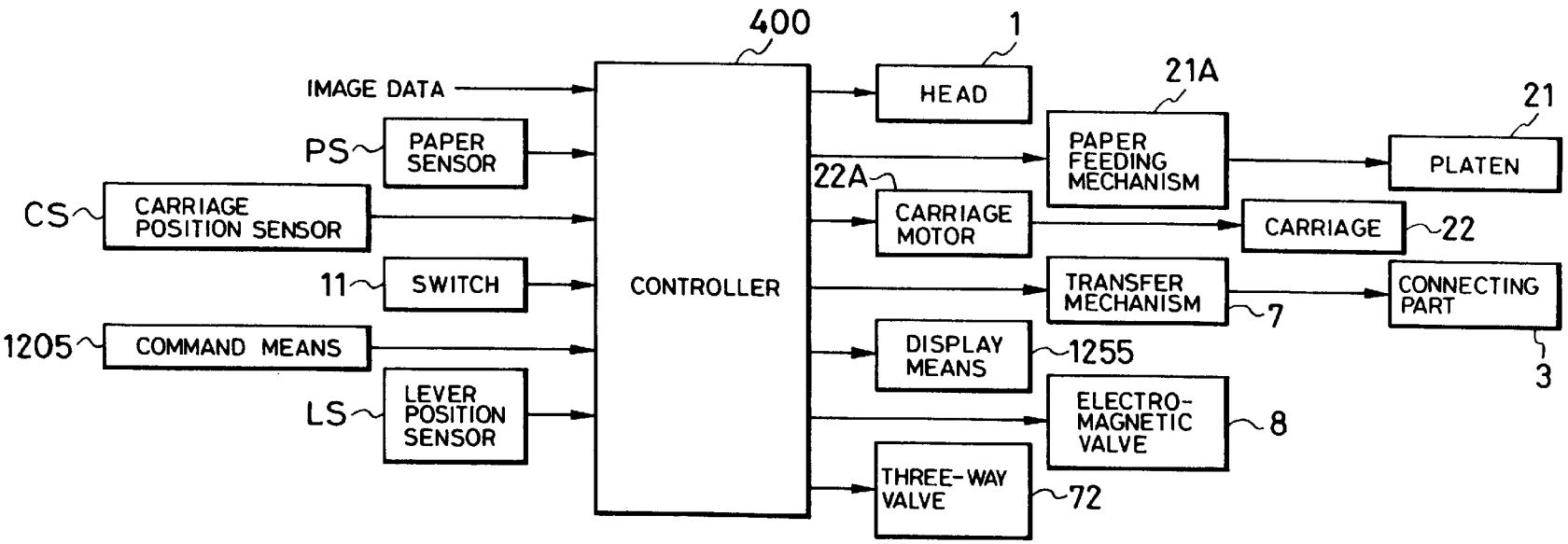
FIG. 24 is a block diagram of a control system in the embodiment shown in FIG. 23.

FIG. 24 shows an arrangement of a control system of the apparatus according to the embodiment shown in FIG. 23. A controller 400 is, e.g., a microcomputer having a CPU, a ROM, a RAM, and so on, controls the respective portions in accordance with the process sequence stored in the ROM, and drives the head 1 based on the image data received from a host unit or the like, thus performing recording. A paper sensor PS detects a recording sheet P. When the paper sensor PS detects a paper sheet, the controller 400 drives a platen roller 21 through a paper feeding mechanism 21A including a paper feed motor, thereby controlling paper feed operation. A carriage position sensor CS detects position of a carriage 22. The controller 400 drives the carriage 22 or controls positioning of the carriage 22 to a home position or the like through a carriage motor 22A in accordance with detected position data from the sensor CS.

The controller 400 uses a carrying mechanism 7 having, in addition to a gear 7A and a cam 7B, a drive member, such as a motor, for transferring a connecting port 3. With the carrying mechanism 7, the controller 400 positions the connecting part 3 with respect to the head 1 in accordance with a contact signal from a switch 11. Command and display means 1205 and 1255 are provided on the operation panel shown in FIG. 1B. A position sensor LS can be arranged to operate in association with the lever 9 or a pump contact 6A. Furthermore, the controller 400 controls switching of the three-way valve 72.

Figure 25:
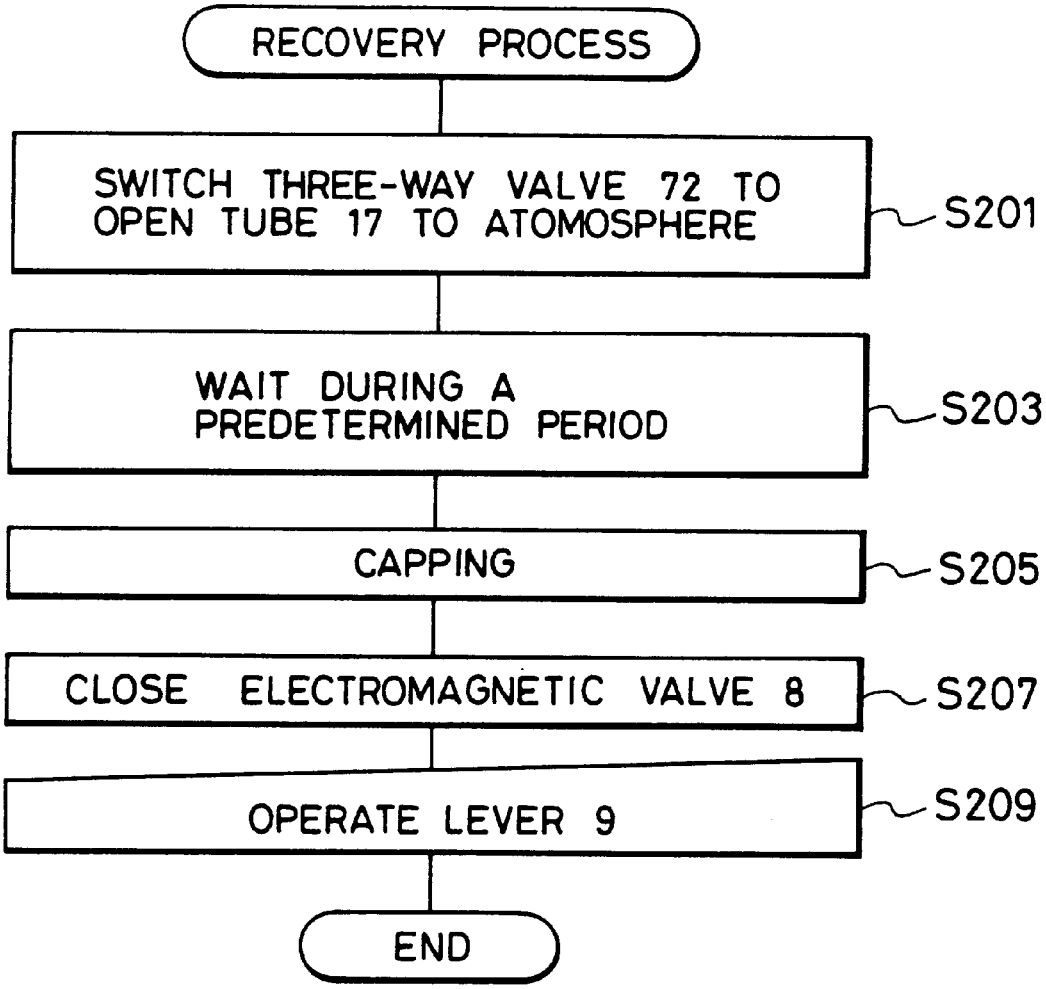
FIG. 25 is a flow chart of a recovery process sequence of the control system shown in FIG. 24.

FIG. 25 shows another example of a recovery process procedure performed by the controller 400 shown in FIG. 24.

When the power source is turned on or the discharge property is degraded, and hence a recovery operation must be performed, the three-way valve 72 is switched to open the tube 17 to the atmosphere in step S210, and a lapse of a predetermined period is waited for in step S203. In this case, since the ink in the supply tube 17 is at a negative pressure, when the tube 17 is opened, the ink is drawn backward to the subtank 12 side, and air is introduced into the supply tube 17. Thereafter, capping of the cap 3A is performed in step S205, an electro-magnetic valve 8 is opened in step S207, and the pump 6 is operated in step S209.

In this case, air fills the supply tube 17. Thus, when negative pressure suction is performed in this state by the pump 6, air is discharged from the discharge port 2 at once, and a flow path resistance is substantially decreased, thereby providing a large suction force. Therefore, factors causing poor discharge in the ink supply path from a subtank 12 to the discharge port 2, i.e., a foreign material such as bubbles present in the filter 30 or in the corner or step of the supply path can be reliably removed.

In the arrangement shown in FIG. 23, a three-way valve is provided between the filter 30 of the ink supply tube 17 and the head 1 in order to switch the ink flow path. However, an opening means, such as an electro-magnetic valve, can be provided instead in order to open the ink flow path. Alternatively, as shown by a broken line L in FIG. 23, a three-way valve can be provided between the filter 30 of the ink supply tube and the subtank 12. The three-way valve can also be arranged at a position to open the liquid chamber in the head 1, e.g., a position indicated by a broken line I in FIG. 23. Such an opening means can be manually operated by the operator when the recovery process is performed.

When the pump 6 is operated to perform ink suction from the discharge port 2 while the supply tube 17 is open to the atmosphere, the effect of this embodiment is enhanced. Additionally, this embodiment can also be effectively applied to an apparatus which does not perform ink supply using a negative pressure. Air introduction can be performed by a given pressure means through a three-way valve or the like.

Figure 26:
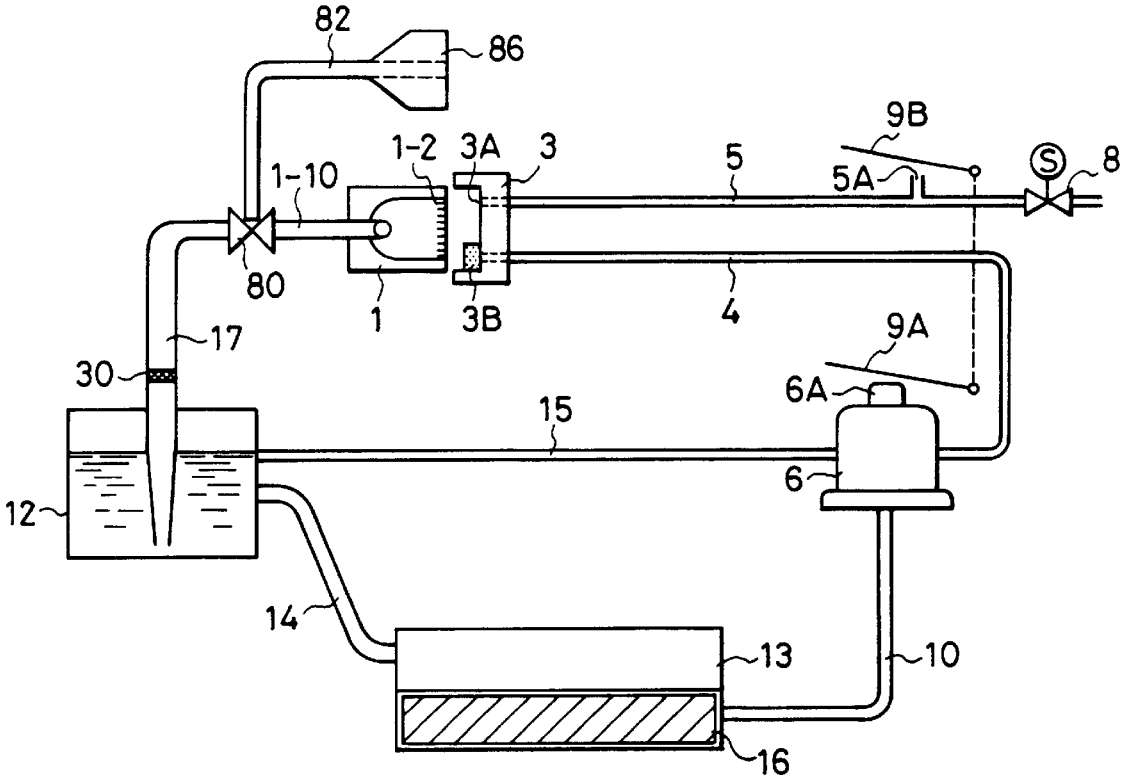
FIG. 26 is a schematic diagram of a main part of an apparatus according to still another embodiment of the present invention.

FIG. 26 shows another example of a main body of the apparatus according to still another embodiment of the present invention. In this embodiment, ink discharge is performed by bypassing a discharge port having a large flow path resistance, without introducing air to inside the discharge port, thereby performing a recovery process.

Referring to FIG. 26, a branch tube 82 branches from a supply tube 17. A connected portion 86, which can be connected with a cap 3A, is formed on the distal end of the branch tube 82. A three-way valve 80 is provided on the branch portion in order to switch the ink flow path from a subtank 12 between the head 1 side and the connected portion 86 side.

A vent valve 5A is provided midway along an atmosphere open tube 5. The vent valve 5A is responsive to the operation of an operation lever 9 and can be closed by a portion 9B of the lever 9. An ink absorber 3B is provided in a cap 3A to hold the ink, and is made of a porous material having a liquid-absorbing property. Note that the cap 3A is generally made of a rubber material, such as a silicone rubber and butyl rubber.

A filter 30 is provided midway along the ink supply tube 17, for trapping a foreign material, such as dust, in the supplied ink, thus prohibiting the foreign material from flowing to the recording head 1 side. A waste ink absorber 16 is arranged in a cartridge 13, for receiving the waste ink drawn by the pump 6 through a waste ink tube 10.

Figure 27:
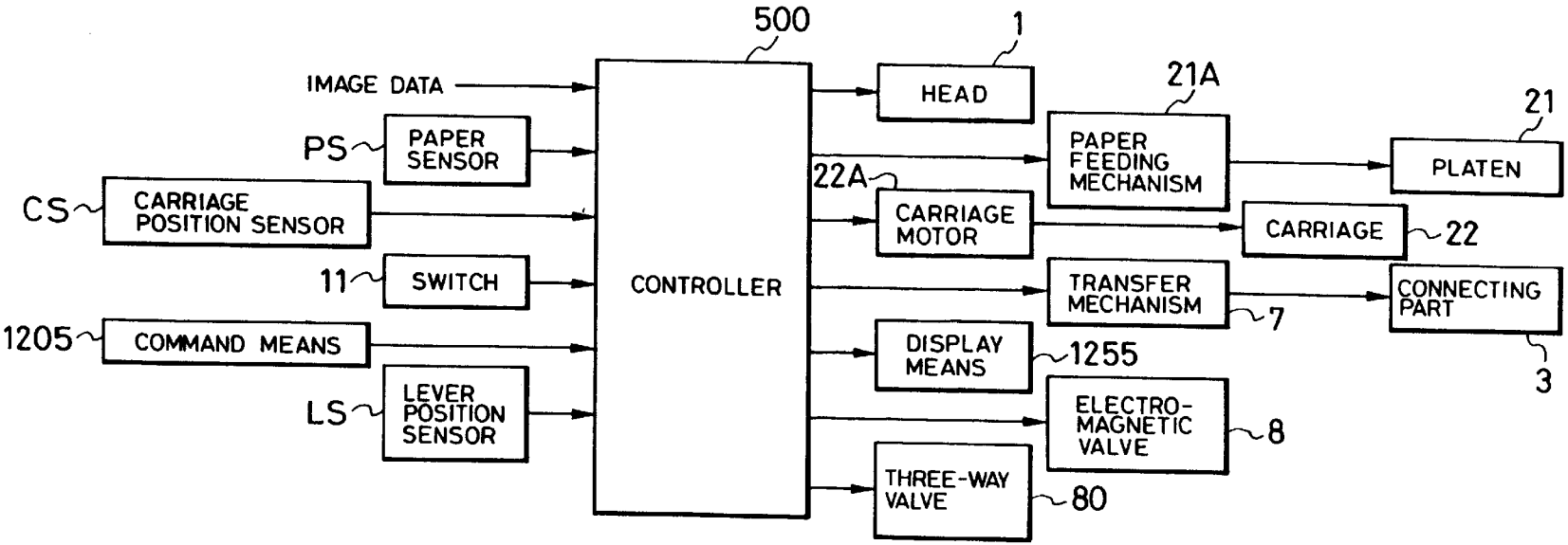
FIG. 27 is a block diagram of a control system of the embodiment shown in FIG. 26.

FIG. 27 shows an arrangement of a control system of the apparatus according to the embodiment shown in FIG. 26. A controller 500 is, e.g., a microcomputer having a CPU, a ROM, a RAM, and so on, controls the respective portions in accordance with the process sequence stored in the ROM, and drives the head 1 based on the image data received from a host unit or the like, thus performing recording. A paper sensor PS detects a recording sheet P. When the paper sensor PS detects a paper sheet, the controller 500 drives a platen roller 21 through a paper feeding mechanism 21A including a paper feed motor, thereby controlling paper feed operation. A carriage position sensor CS detects a position of a carriage 22. The controller 500 drives the carriage 22 or controls positioning of the carriage 22 to a home position or the like through a carriage motor 22A in accordance with detected position data from the sensor CS.

The controller 500 uses a transfer mechanism 7 having, in addition to a gear 7A and a cam 7B, a drive member, such as a motor, for transferring a connecting part 3. With the transfer mechanism 7, the controller 500 positions the connecting part 3 with respect to the head 1 in accordance with a contact signal from a switch 11. Command and display means 1205 and 1255 are provided on the operation panel shown in FIG. 1B. A position sensor LS can be arranged to operate in association with a lever 9 or a pump contact 6A. Furthermore, the controller 500 controls switching of the three-way valve 80 for a recovery process.

Figure 28:
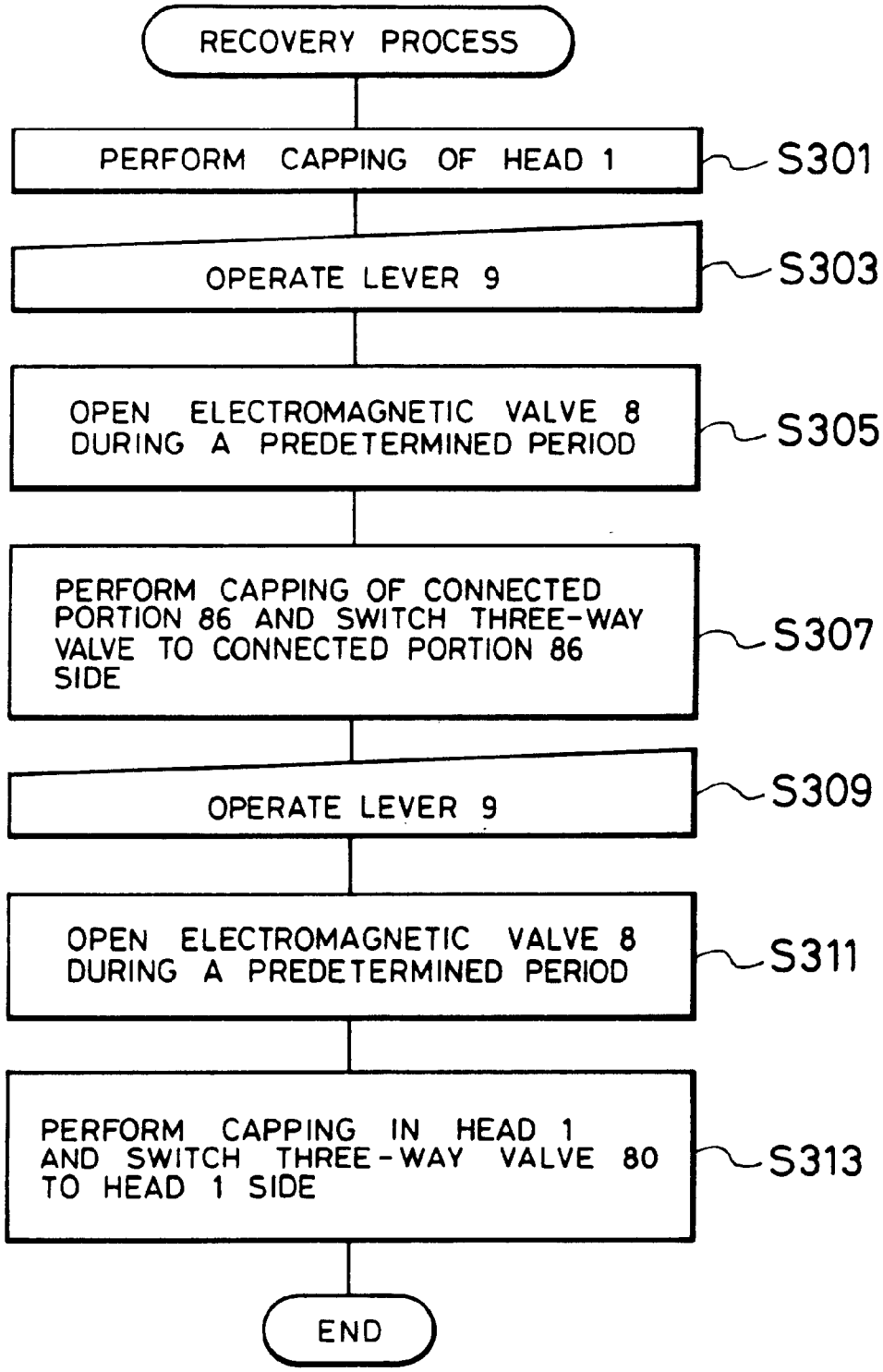
FIG. 28 is a flow chart of a recovery process sequence of the control system shown in FIG. 27.

FIG. 28 shows an example of a recovery process by the controller 500 shown in FIG. 27. First, when the carriage 22 is positioned at the home position while the power source is turned on or at an appropriate timing during a recording process, the head 1 is moved toward the connecting part 3 and capping is performed in step S301. In this case, the electro-magnetic valve 8 is closed.

In this state, the lever 9 is moved from the off- to on-position and is released in step S303. At this time, a vent valve 5A is closed, and ink suction is performed in accordance with the movement of the lever 9 to the on-position.

Subsequently, an electro-magnetic valve 8 is opened for a predetermined period to open the connecting port to the atmosphere in step S305, thereafter the connecting part 3 is detached from the head 1 in step S307, the carriage 22 is driven to oppose a connected portion 86 with the connecting part 3, capping is performed, and a three-way valve 80 is controlled to switch the ink flow path to the connected portion 86 side. Then, the lever 9 is operated in step S309 and suction process from the connected portion 86 side is performed. Namely, with this operation, the ink is discharged at once from the connected portion 86 having a smaller flow path resistance. As a result, factors causing poor discharge in the ink supply path from the subtank 12 to at least the three-way valve 80, e.g., a foreign material such as bubbles present in the filter 30 or in the corner or step of the ink supply path, can be reliably removed.

After such a suction process, the electro-magnetic valve 8 is opened for a predetermined period in step S311, capping is performed on the head 1 and the flow path is switched by the three-way valve 80 to the head 1 side in step S313, thus ending the process, and a following recording process is waited for.

In this embodiment, a first suction process from the head 1 is performed, and thereafter a second suction process from the connected portion 86 is performed. However, such a second suction process can be performed when necessary, e.g., only when the first suction process is insufficient. Also, in this embodiment, the pump 6 and the connecting part 3 serve as common means for performing ink suction from the head 1 and the connected portion 86. However, separate pumps and connection portions can be provided, and the suction path can be selected by switching a three-way valve. Furthermore, the branch tube from the three-way valve can be directly introduced to the suction tube 4 or the pump 6.

Figure 29:
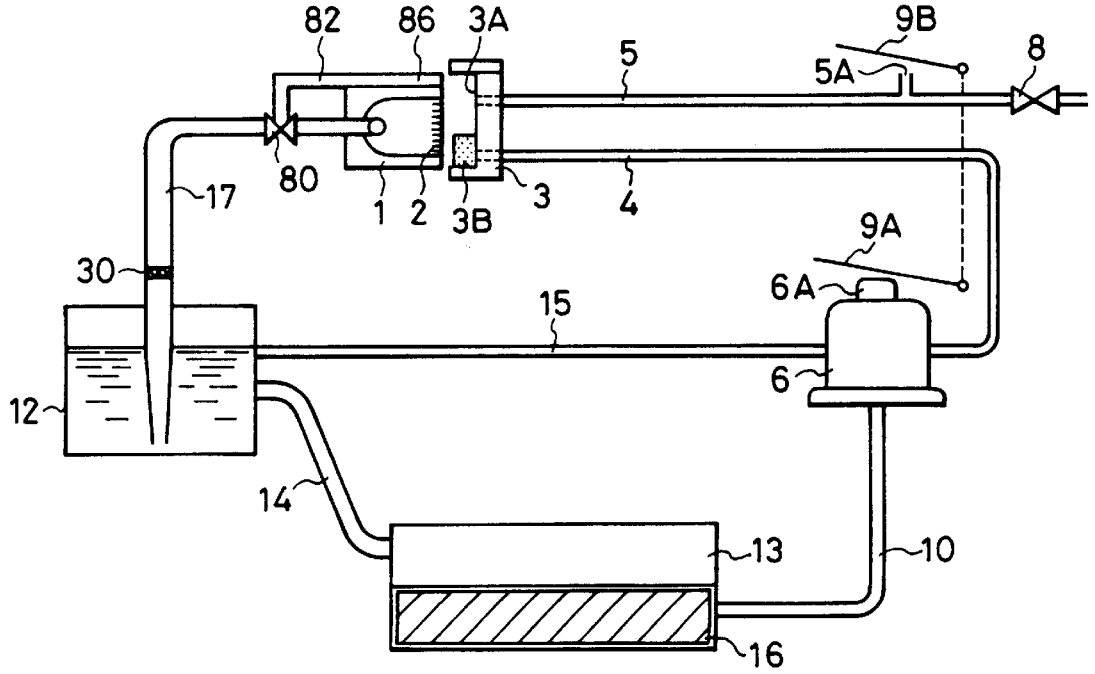
FIG. 29 is a schematic diagram of a modification of the apparatus shown in FIG. 26.

In addition, the connected portion 86 can be integrally provided in the head 1, as shown in FIG. 29. In this case, control can be performed more easily.

In the above description, the present invention is applied to a serial-type ink-jet recording apparatus. However, the present invention can be applied to any type of ink-jet recording apparatuses which perform recording by discharging ink from discharge ports. For example, the present invention can be applied to a full multi-type apparatus having a plurality of discharge units along the width of a recording paper sheet.

In the above description, operation of the pump and so on is manually performed. However, a given drive means can be used with ease to operate the pump and so on during control.

As described above, according to the present invention, an ink-jet recording apparatus can be provided wherein a sufficient flow velocity is maintained without increasing the apparatus size, thus performing a reliable discharge recovery process.

According to the present invention, a foreign material in an ink supply path connected to a discharge port, such as bubbles or dust present in the filter in the supply path or a step or corner of the supply path, can be appropriately removed by a high-velocity fluid.

According to the present invention, a foreign material in an ink supply path connected to a discharge port, such as bubbles or dust present in the filter in the supply path or a step or corner of the supply path, can be appropriately removed by flowing an ink not going through a discharge port having a high flow path resistance.

According to the present invention, a gas can be easily intorduced from an opening to an ink supply path in order to flow an ink at a high velocity together with the gas introduced into the ink supply path, thereby discharging the ink quickly and reliably.

According to the present invention, an ink is caused to flow at a high velocity together with a gas introduced into an ink supply path inside a discharge port, in order to eliminate factors causing poor discharge, such as clogging of the discharge port, as well as to appropriately remove a foreign material in the ink supply path connected to the discharge port, such as bubbles or dust present in a filter in the supply path or a step or corner of the supply path.

According to the present invention, once air is introduced by connection, it is appropriately introduced into an ink supply path without being absorbed back even when the discharge path is released and, when the ink is to be discharged, it is caused to flow at a high velocity together with the gas introduced into the ink supply path inside the discharge port, so that factors causing poor discharge, such as clogging of the discharge port, can be eliminated, and a foreign material in the ink supply path connected to the discharge port, such as bubbles or dust present in the filter on the supply path or in a step or corner of the supply path, can be appropriately removed.

According to the present invention, before a gas is introduced into an ink supply path by means of repeated connection/disconnection of the discharge port, an ink can be discharged to fill a connection means, so that an increased pressure sufficient for air introduction can be obtained, and the ink is caused to flow at a high velocity and is discharged together with the gas introduced into the ink supply path inside the discharge port, so that factors causing poor discharge, such as clogging of the discharge port, can be eliminated, and a foreign material in the ink supply path connected to the discharge port, such as bubbles or dust present in the filter in the supply path or in a step or corner of the supply path, can be appropriately removed.

According to the present invention, an ink discharge process is performed to discharge an ink from a discharge port in order to restore discharge, and a simple operation of holding an ink-containing member at a second mount position is performed in association with the ink discharge process, so that the ink supply path can be reliably blocked, thus aiding a discharge recovery process for increasing the flow velocity of a fluid in the supply path.

What we claim is:

1. A method for recovering an ink jet head having an opening communicating with a discharge port, the opening being provided on a same planar surface on which the discharge port for discharging ink is provided, an area of the opening being larger than an area of the discharge port, said method comprising the steps of:

capping the ink jet head with a cap having a space, the cap covering the opening and the discharge port such that the opening and the discharge port commonly communicate with the space of the cap during capping;

forcibly introducing gas into the ink jet head simultaneously through the discharge port and the opening by utilizing the cap; and exhausting the gas introduced into the ink jet head in said introducing step with ink through the discharge port and the opening, wherein the gas introduced into the ink jet head enables the ink to be exhausted at an increased velocity in said exhausting step.

2. A method according to claim 1, wherein in said introducing step gas is introduced into a liquid chamber of the ink jet head.

3. A method according to claim 1, wherein in said exhausting step suction is applied to the ink jet head to suction the introduced gas and ink through the discharge port.

4. A method according to claim 1, wherein said introducing and exhausting steps are performed a plurality of times.

5. An ink jet apparatus for use with a mountable ink jet head having an opening communicating with a discharge port, the opening being provided on a same planar surface on which the discharge port for discharging ink is provided, said apparatus comprising:

a cap having a space, said cap covering the opening and the discharge port such that the opening and the discharge port commonly communicate with the space of said cap during capping, said cap forcibly introducing gas into the ink jet head simultaneously through the discharge port and the opening; and exhausting means for exhausting the gas introduced into the ink jet head with ink through the discharge port and the opening, wherein an area of the opening is larger than an area of the discharge port and the gas introduced into the ink jet head enables the ink to be exhausted at an increased velocity by said exhausting means.

6. An ink jet apparatus according to claim 5, wherein the ink jet head includes a liquid chamber and said cap introduces gas into the liquid chamber of the ink jet head.

7. An ink jet apparatus according to claim 5, wherein said exhausting means applies suction to the ink jet head to suction the introduced gas and ink through the discharge port.

8. An apparatus according to claim 5, wherein said cap comprises an ink absorbing member for absorbing ink.

9. An apparatus according to claim 8, wherein at least one part of said cap is made of a material selected from a silicone rubber and a butyl rubber.

10. An ink jet apparatus for use with a mountable ink jet head having an opening communicating with a discharge port, the opening being provided on a same planar surface on which the discharge port for discharging ink is provided, said apparatus comprising:

a cap having a space, said cap covering the opening and the discharge port such that the opening and the discharge port commonly communicate with the space of said cap during capping, said cap forcibly introducing gas into the ink jet head simultaneously through the discharge port and the opening; and a pump for generating negative pressure and exhausting the gas introduced into the ink jet head with ink through the discharge port and the opening, wherein an area of the opening is larger than an area of the discharge port and the gas introduced into the ink jet head enables the ink to be exhausted at an increased velocity by said pump.

* * * * *

UNITED STATES PATENT AND TRADEMARK OFFICE

CERTIFICATE OF CORRECTION

PATENT NO. : 6,196,655 B1
DATED : March 6, 2001
INVENTOR(S) : Hirasawa et al.

It is certified that error appears in the above-identified patent and that said Letters Patent is hereby corrected as shown below:

Drawings,
Sheet 5, Figure 6A, "MIDDIUM-" should read -- MEDIUM- --.
Sheet 21, Figure 25, "ATOMOSPHERE" should read -- ATMOSPHERE --.

Column 2,
Line 48, "removed,.and" should read -- removed, and --.
Line 51, "one" should read -- an --.
Line 61, "is" should read -- is a --.
Line 63, the right margin should be closed up.
Line 64, "comprises;" should read -- comprises: --.

Column 3,
Line 10, "introducting" should read -- introducing --.
Line 22, "meidum" should read -- medium --.

Column 5,
Line 13, "sumping" should read -- pumping --.
Line 20, "means, and" should read -- means; and --.
Line 36, "discharges" should read -- discharge --.

Column 6,
Line 22, "charts..showing" should read -- charts showing --.

Column 11,
Line 45, "a" should be deleted.

Column 12,
Line 7, "operated" should read -- operate --.
Line 24, "SA" should read -- 5A --.
Line 32, "to" should read -- to the --.
Line 33, "suction" should read -- the suction --.

Column 13,
Line 3, "performing" should read -- performing the --.
Line 30, "Air-introduction" should read -- The air-introduction --.

Column 14,
Line 2, "head 1" should read -- head 1-1 --.
Line 9, "head X," should read -- head 1-1, --.
Line 18, "discharge" should read -- discharge port 2 --.
Line 19, "discharge" should read -- discharge port 2 --.

UNITED STATES PATENT AND TRADEMARK OFFICE

CERTIFICATE OF CORRECTION

PATENT NO. : 6,196,655 B1
DATED : March 6, 2001
INVENTOR(S) : Hirasawa et al.

It is certified that error appears in the above-identified patent and that said Letters Patent is hereby corrected as shown below:

Column 14,
Line 22, "perform" should read -- perform the --.

Column 15,
Line 20, "above," should read -- above, the --.
Line 28, "when" should read -- when the --.
Line 67, "a" should be deleted.

Column 16,
Line 23, "port" should read -- part --

Column 17,
Line 31, "a" should be deleted.

Column 18,
Line 9, "port" should read -- part 3 --.
Line 16, "and" should read -- and a --.
Line 63, "a" should be deleted.

Signed and Sealed this

Twenty-second Day of January, 2002

*Attest:*

*Attesting Officer*

JAMES E. ROGAN
*Director of the United States Patent and Trademark Office*